US007334339B2

(12) United States Patent
Miltner et al.

(10) Patent No.: US 7,334,339 B2
(45) Date of Patent: Feb. 26, 2008

(54) FOLDING KNIVES

(76) Inventors: Richard H. Miltner, 750 Skyline Trail, Topanga, CA (US) 90290; Julie L. Adams, 750 Skyline Trail, Topanga, CA (US) 90290

( * ) Notice: Subject to any disclaimer, the term of this patent is extended or adjusted under 35 U.S.C. 154(b) by 8 days.

(21) Appl. No.: 11/046,299

(22) Filed: Jan. 27, 2005

(65) Prior Publication Data

US 2005/0153641 A1 Jul. 14, 2005

Related U.S. Application Data

(63) Continuation-in-part of application No. 10/684,293, filed on Oct. 10, 2003.

(60) Provisional application No. 60/475,362, filed on Jun. 3, 2003, provisional application No. 60/460,164, filed on Apr. 3, 2003, provisional application No. 60/418,070, filed on Oct. 11, 2002.

(51) Int. Cl.
*B26B 1/02* (2006.01)

(52) U.S. Cl. ..... 30/138; 30/155; 30/357

(58) Field of Classification Search ..... 30/346, 30/357, 36, 398.4, 138, 298.4, 155–161; D8/98, 99, 105, 107; 7/118–120; 451/555; 76/82, 86, 88, 104.1
See application file for complete search history.

(56) References Cited

U.S. PATENT DOCUMENTS 1,299,173 A 4/1919 Grey
1,627,689 A * 5/1927 Culver ..... 7/120
1,820,234 A 8/1931 Elsa
2,658,272 A * 11/1953 Lillard ..... 30/125
2,791,831 A 5/1957 Hollis
4,501,068 A * 2/1985 Palson ..... 30/138
5,181,321 A 1/1993 Gouttebarge
5,241,883 A 9/1993 Coppier
5,437,101 A 8/1995 Colliins
5,537,750 A 7/1996 Seber et al.
5,605,495 A * 2/1997 Jenkins, Jr. ..... 451/45
5,647,129 A 7/1997 Stamper
5,755,035 A 5/1998 Weatherly (Continued)

OTHER PUBLICATIONS

Steve Bottorff, *Sharpening Made Easy: A Primer on Sharpening Knives and Other Edged Tools*, copy of front of Book (1 page), copy of page with copyright information (1 page), copy of Table of Contents (2 pages), and pp. 56 and 57, © Copyright 2002 by Knife World Publications, Knoxville, TN.

(Continued)

*Primary Examiner*—Kenneth E. Peterson
*Assistant Examiner*—Phong Nguyen

(57) ABSTRACT

In an exemplary sharpening element storage embodiment of the present invention, a sharpening element (5000) may be inserted in a groove (5001) that would be provided in an interior wall (5004) of a knife handle (or knife blade housing) (5005). When the first notch (5002), located in the blade's tongue (5003), in the knife blade (5006) is aligned with the conforming shape of the first end (5008) of the groove (5001), it would be possible to move the sharpening element (5000) in the direction of the opposing handle part (not shown), out from the groove (5001), in order to extract the sharpening element (5000) completely out from the knife handle (5005) for use.

8 Claims, 17 Drawing Sheets

U.S. PATENT DOCUMENTS

| | | | | |
|---|---|---|---|---|
| 5,781,998 | A | 7/1998 | Stamper | |
| 5,819,414 | A | 10/1998 | Marifone | |
| 6,014,787 | A | 1/2000 | Rivera | |
| 6,105,255 | A | 8/2000 | Cheng | |
| 6,224,475 | B1 | 5/2001 | May et al. | |
| 6,293,020 | B1 | 9/2001 | Julien | |
| 6,618,947 | B1 | 9/2003 | Gardiner et al. | |
| 6,643,934 | B2 | 11/2003 | Pope | |
| 6,718,639 | B1 | 4/2004 | Kazanjian | |
| D495,940 | S | 9/2004 | Keppel et al. | |
| 2002/0157260 | A1* | 10/2002 | Cheng | 30/161 |

OTHER PUBLICATIONS

Advertisement for Fred Carter™ Custom Design, *Blade* Magazine, Mar. 2003, pp. 15 and 16, © 2002 United Cutlery Corp., United® Cultery Brands, Sevierville, TN.

* cited by examiner

FIG. 1
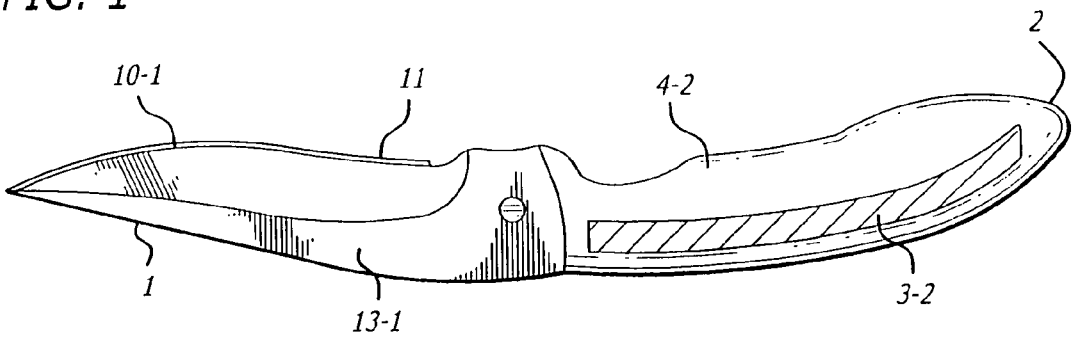
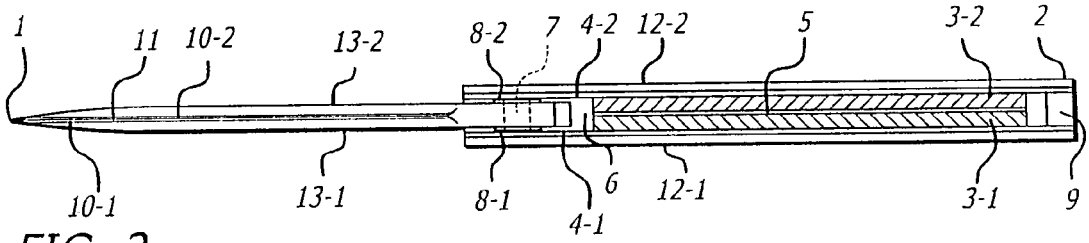
FIG. 2
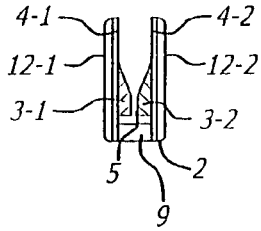
FIG. 2-1
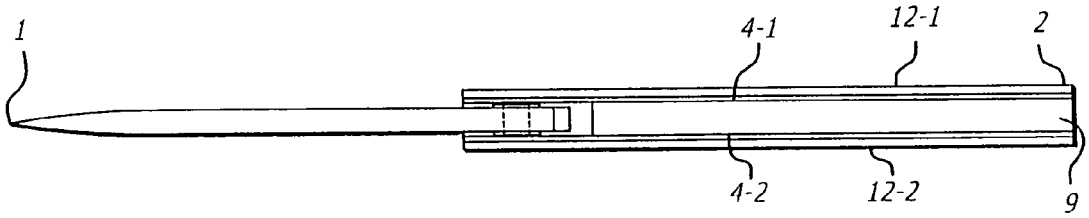
FIG. 3

FIG. 4
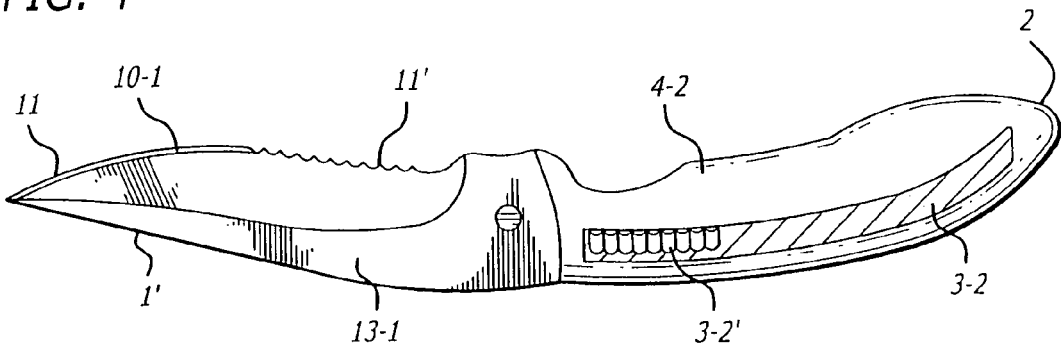
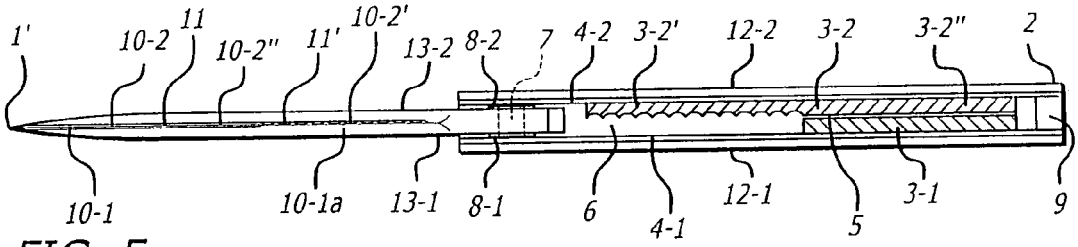
FIG. 5
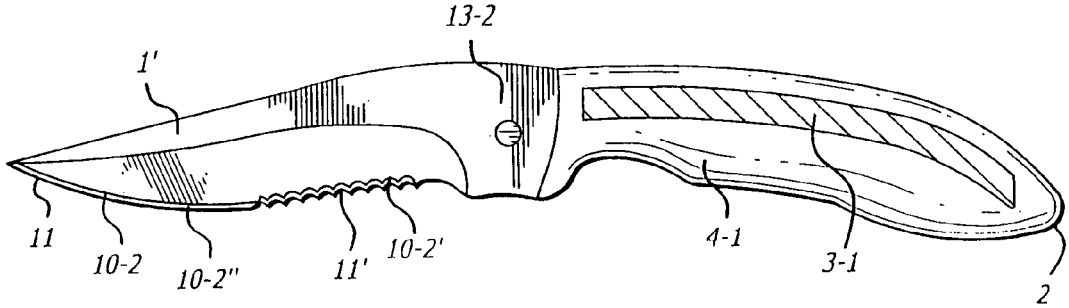
FIG. 6

FIG. 8
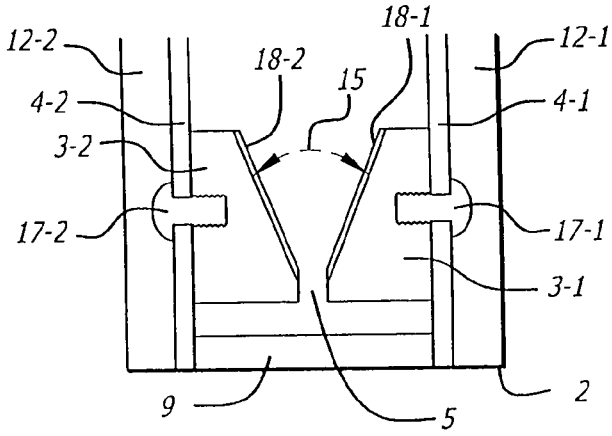
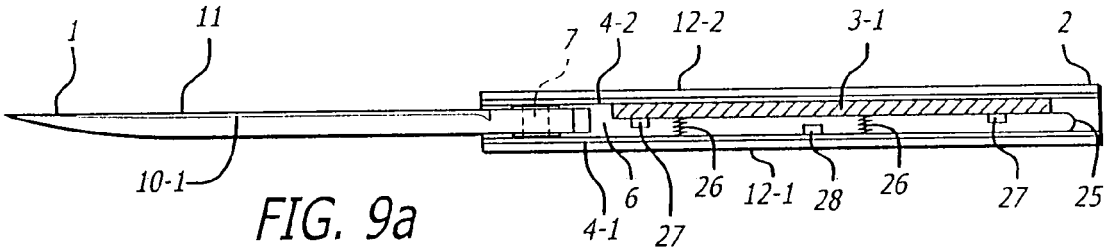
FIG. 9a
FIG. 9b
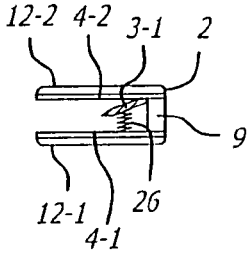
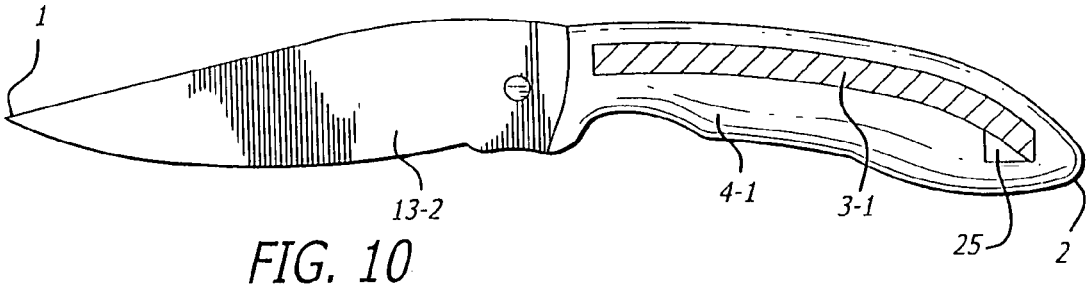
FIG. 10

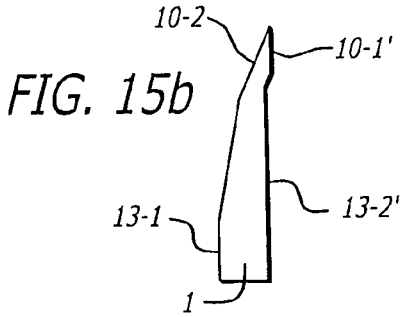
FIG. 15b
FIG. 15c
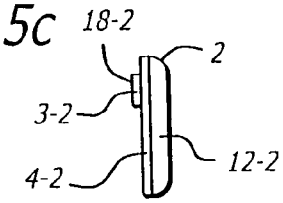
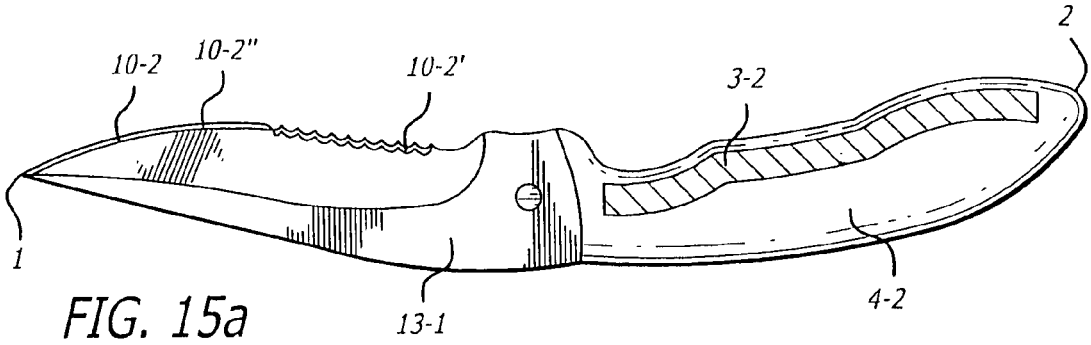
FIG. 15a
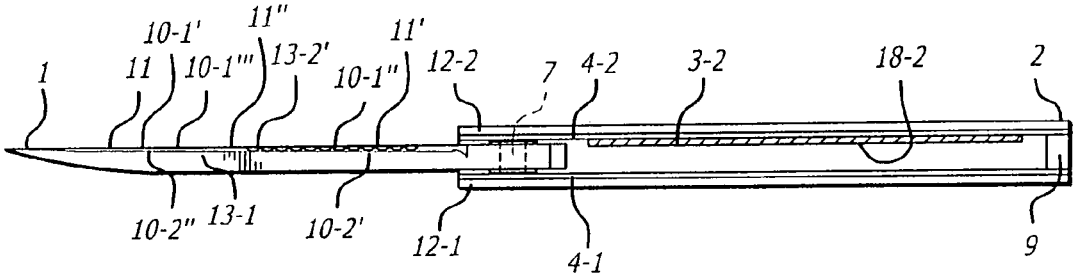
FIG. 16
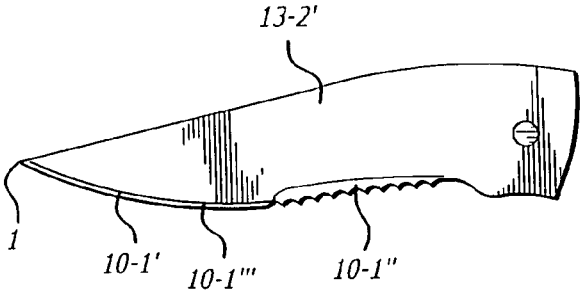
FIG. 17

FIG. 30a
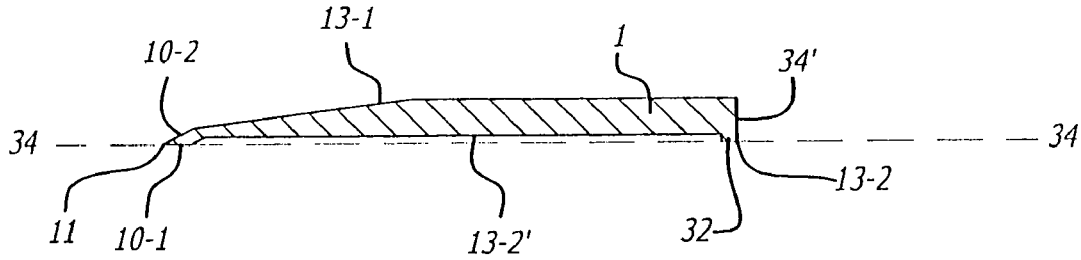
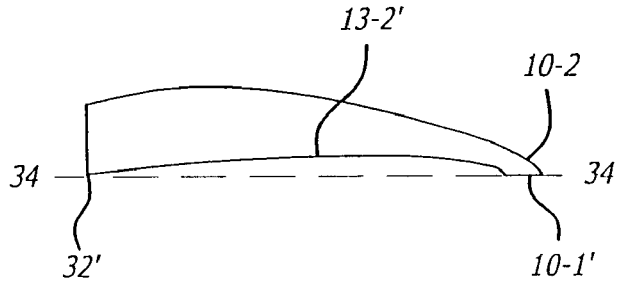
FIG. 30b
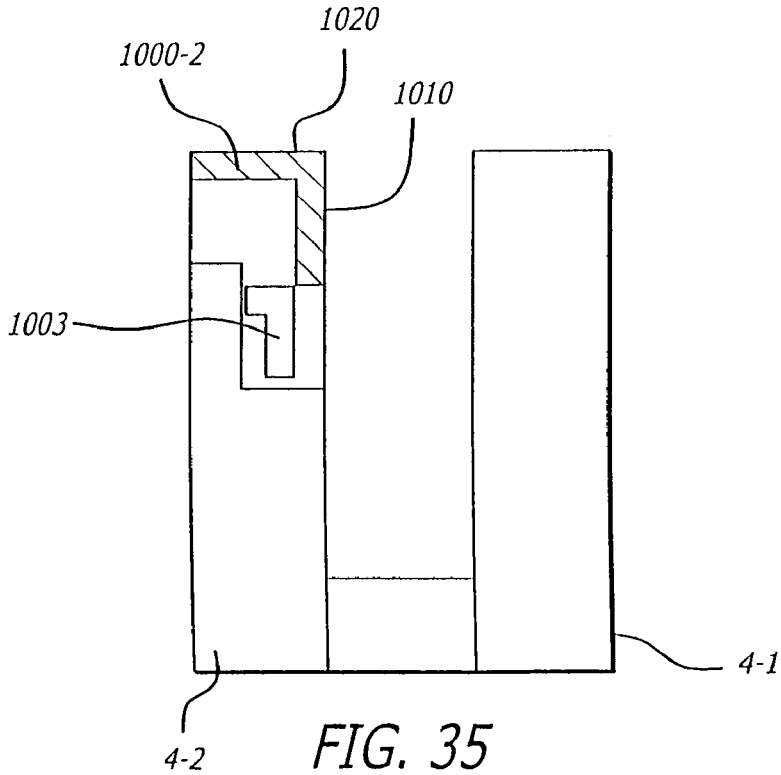
FIG. 35

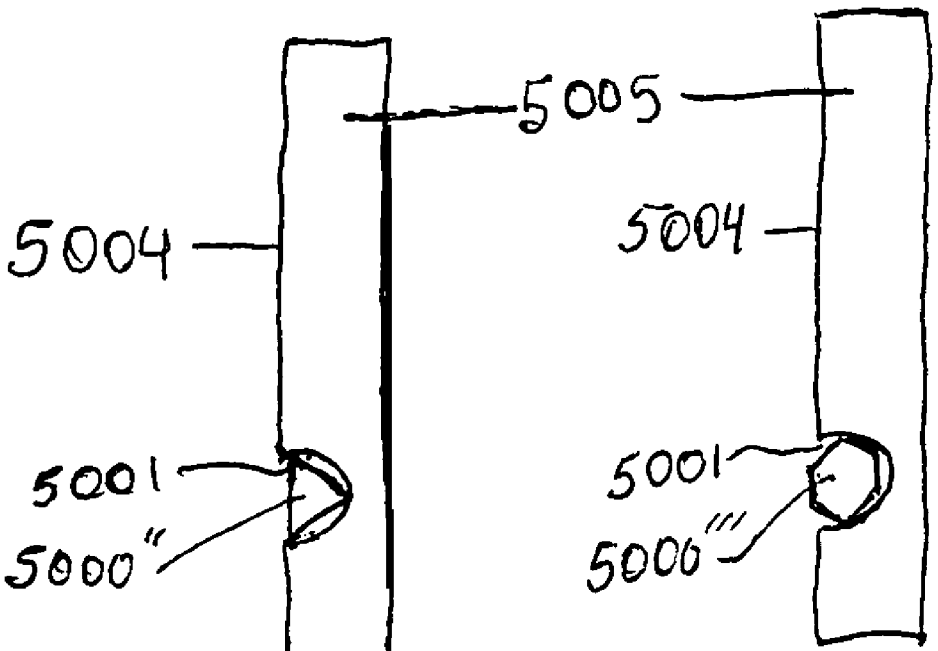
FIG. 43c
FIG. 43b
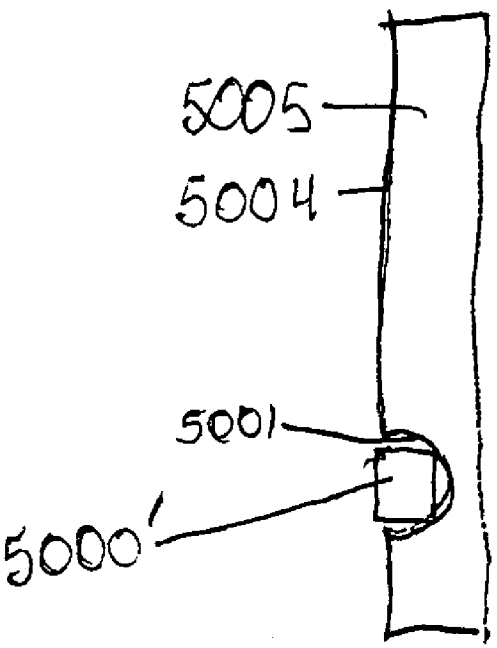
FIG. 43a

FOLDING KNIVES

CROSS-REFERENCE TO RELATED APPLICATIONS

This is a continuation-in-part application claiming priority to co-pending U.S. patent application Ser. No. 10/684,293, filed on Oct. 10, 2003, entitled "FOLDING KNIVES" (the disclosure of all of which is incorporated for all purposes herein in full by reference as if stated in full herein), which claimed priority to: U.S. Provisional Patent Application Ser. No. 60/418,070, entitled "INTERNAL SHARPENING ELEMENT FOR FOLDING KNIVES", filed on Oct. 11, 2002; U.S. Provisional Patent Application Ser. No. 60/460,164, entitled "INTEGRAL FOLDING KNIFE SHARPENER", filed Apr. 3, 2003, and U.S. Provisional Patent Application Ser. No. 60/475,362, entitled "FOLDING KNIVES", filed on Jun. 3, 2003, the disclosures of all of which are incorporated for all purposes herein in full by reference as if stated in full herein.

FIELD OF THE INVENTION

The field of the present invention is knives, and specifically folding knives.

BACKGROUND OF THE INVENTION

Knives are one of the oldest tools made by humans. Since the time that the first knives were made from stone, a lot has changed. Knife smiths have developed the art of blade forging. Blade designs, the forging process and steel materials have been improved over time in an effort to hold knife blade edges as sharp as possible. Even so, a knife must still be sharpened from time to time.

As will be understood by someone with ordinary skill in the art, knife blades are designed to have sharp edges. Knife blade edges are formed by the intersection of two surfaces, or "bevels".

There are many different variations of blade profiles, including among others: flat, wedge, convex, concave and chisel. Edge profiles can be convex, flat, concave, or chisel.

Many knife blade edge profiles are formed by the intersection of two angled (flat, convex, or concave) bevels—these types of blades are generally referred to herein as double sided, or alternatively, as double bevel. As compared to a double bevel edge, a chisel edge profile (sometimes referred to herein as a chisel ground blade, or as a "single-sided" blade) is formed by the intersection of an angled bevel and a flat side—the flat side being parallel to (having a zero degree angle relative to) the blade centerline.

As will be understood by someone with ordinary skill in the art, knife blade edges are sharpened by grinding (polishing, or wearing down, as with an abrasive) the surfaces that form the edge. That is, a double sided, or double bevel, edge, is generally sharpened by grinding the respective angled bevels with a sharpening element; a conventional single sided, or chisel ground, edge, is generally sharpened by grinding the single angled bevel.

It is difficult to consistently sharpen a knife blade correctly, because the person sharpening the blade must match the angle of the blade's edge, with the surface of the sharpening device.

Folding knives are carried and used by many people. Folding knives are especially valuable to people on the go who, from time to time find the need for a knife but who need to conserve space and provide for safety in carrying a sharp implement. For example, campers and hunters may pack fixed blade knives for use at camp, but also may carry a folding knife in their pocket for use while hiking, hunting, or the like. Mountain climbers and other sports enthusiasts may carry a folding knife in a backpack or pocket for use, just in case they need it. Military personnel may carry folding knives while on a mission.

A person that carries a folding knife should be able to rely on the sharpness of the knife. However, a person who carries a folding knife may forget to unpack the knife and sharpen it. Moreover, appropriate equipment is needed to correctly sharpen a blade. Because appropriate sharpening equipment is often cumbersome or may require electricity to operate, it is unlikely that a person would carry such equipment in the field. Many portable field sharpeners currently exist, however, it is difficult to use these sharpeners and difficult to maintain the correct angle. Additionally, sharpening equipment is a separate piece of equipment; it is often not convenient to carry such separate equipment. Further, serrated knife blades can be extremely difficult to sharpen. A better way of sharpening folding knives is needed.

SUMMARY OF THE INVENTION

One exemplary embodiment of the present invention provides a sharpening element that is mounted in and integral to the interior cavity of a folding knife handle. The blade of a knife in the exemplary embodiment of the present invention can be sharpened during unfolding (opening) or folding (closing) the knife blade into the interior cavity of the folding knife handle. In one embodiment, the folding blade comprises a convex side with an angled bevel and further comprises a hollow ground side with a small raised flat bevel, the blade further comprising a sharp edge formed by the intersection of the angled bevel and the small raised flat bevel.

It will be understood by someone with ordinary skill in the art that depictions herein as to the length and/or width of the sharpening elements are not a limitation of the invention. Sharpening elements, such as, e.g., sharpening element 3-1 depicted in FIGS. 28 and 29, can be wide—even wider than, in the case depicted in FIGS. 28 and 29, the small raised flat bevel 10-1'. Or, as depicted, e.g., in FIGS. 24*a* and 24*b*, sharpening element 3-2 is more narrow, and could be narrower or wider than the bevel, in this case (as depicted in FIG. 26*a*) 10-1', that is being sharpened.

The interior-mounted sharpening element may be located on one or both sides of the interior cavity of the folding knife handle. Each side of the interior-mounted sharpening element will be contoured, tapered, and mounted to be parallel to a preferred angulation of the sharpened folding blade. The interior-mounted sharpening element may be in one or two pieces, depending upon whether the particular knife blade provides a single-sided or double-sided sharpening edge.

An interior-mounted sharpening element may have one, two or even more exposable sides (sometimes referred to herein as a "multi-sided sharpening element") and may provide multiple grits. For example, each exposable side may comprise a particular grit; each exposable side may have a grit that is different from the grit used on one or more of the other exposable sides of the sharpening element. The multi-sided sharpening element can be fixed-mounted or removeable. A fixed-mounted version would provide one interior and one or more exterior sharpening surfaces, giving the user the ability to use the exterior surface to sharpen knife blades, tools, etc. other than the blade that is connected to the handle. A multi-sided removeable version (sometimes referred to herein as an "exchangeable sharpening element") can be constructed in a way that it can be removed and/or repositioned inside the folding knife handle so that the grit can be changed.

The following categories of exemplary embodiments of the sharpening feature of the present invention are described herein: 1.) selective sharpening embodiments, 2.) non-selective sharpening embodiments; and 3.) combination selective and non-selective sharpening embodiments.

Several variations of selective sharpening embodiments are described herein. A first exemplary embodiment of selective sharpening would provide a fixed mounted sharpening element and would provide some lateral wiggle for the knife blade. During the opening or closing of the knife blade, pressure may be applied, such as by a finger of a user, to one or the other side of the blade as it is unfolded (opened) from or folded (closed) into the knife handle.

The manually-applied pressure to a side of the blade will cause the opposing angled bevel, or raised flat bevel, as the case may be, of the blade to contact the corresponding interior-mounted sharpening element. As the blade is unfolded (opened) from or folded (closed) into the knife handle, if the manual pressure is continued, the opposing angled bevel, or raised flat bevel, as the case may be, of the blade will be sharpened as it passes over the surface of the interior-mounted sharpening element. That is, when the blade is open, and is in the process of being closed, the interior-mounted sharpening element can contact the angled bevel of the blade beginning at the point when the blade forms an approximately forty-five degree angle relative to the handle into which it is being closed; contact between the interior-mounted sharpening element and the angled bevel of the blade can continue, as long as pressure continues to be applied to the side of the blade opposing the angled bevel being sharpened, from the point at which the blade forms a forty-five degree angle relative to the handle, until the blade is fully closed, forming approximately a zero degree angle relative to the handle.

Similarly, when the blade is closed, and is in the process of being opened, the interior-mounted sharpening element can contact the angled bevel of the blade, as long as pressure continues to be applied to the side of the blade opposing the angled bevel being sharpened, beginning as the blade is raised from a completely closed zero degree angle relative to the handle until the point at which the blade forms an approximately forty-five degree angle relative to the handle from which the blade is being opened.

A second exemplary embodiment of selective sharpening would provide a moveably mounted sharpener. In this second selective sharpening exemplary embodiment, a weak spring would hold the sharpener away from the blade, while a manually activated push-button would be provided to make it possible to press the sharpener from the outside handle surface towards and against the blade during the sharpening process.

A third exemplary embodiment of selective sharpening would provide a removable sharpening element, sometimes referred to herein as an "exchangeable" sharpening element. The exchangeable sharpening element could be provided in an Integral Folding Knife Sharpener embodiment, or alternatively, could also be used in a folding knife that does not have an Integral Folding Knife Sharpener. One or more sharpening elements could be stored in the knife handle in a storage area or storage compartment disposed in the knife handle. Many different ways to do so are possible. The sharpening elements could be stored in the knife handle. If a user wanted to sharpen a knife blade, the user would simply extract or free the sharpening element from the storage area in the knife handle, and use the sharpening element to sharpen the blade. After using the sharpening element, the user would replace the sharpening element back into the storage area or storage compartment in the knife handle.

The exchangeable sharpening element could be constructed in the form of a long element, such as a rod or stick, with two, three or, four sides, or even more. Exchangeable sharpening element(s) could have different shapes such as, flat (two-sided), rod-shaped (essentially round from an end view of the sharpening element), square (four-sided from an end view of the sharpening element), triangular (three-sided from an end view of the sharpening element), etc.

On a rod-shaped element having a length and an exterior circumference, different grits could be disposed on different areas of the rod. As a non-limiting illustrative example, a first grit could be disposed on a first longitudinal area of a rod-shaped sharpening element wherein the first longitudinal area of the rod-shaped sharpening element spans the length of the rod and is disposed on a first portion of the circumference of the rod; a second grit could be disposed on a second longitudinal area of the rod-shaped sharpening element wherein the second longitudinal area of the rod-shaped sharpening element spans the length of the rod and is disposed on a second portion of the circumference of the rod.

Similarly, on a multi-sided exchangeable sharpening element, a different grit, or no grit, could be disposed on each side or area of the element. A multi-sided or rod-shaped sharpening element embodiment could provide a plain (no grit) side or area. Such a plain (no grit) side or area could be used for steeling a blade.

When an Integral Sharpener is used in a folding knife with a Hollow Flat folding knife blade, the integral sharpening element, which will sharpen the flat side of the blade, is also well-suited to provide different grits.

In an exemplary embodiment of an exchangeable sharpening element, the exchangeable sharpening element is "L"-shaped. The exchangeable sharpening element can be mounted to the interior wall of the handle, so that it can be rotated on, or shifted about, its longitudinal axis. This third exemplary embodiment of selective sharpening will give the user the ability to choose one of a plurality of grits the user wants to use. Different ways to lock and unlock the exchangeable sharpening element are possible. The exchangeable sharpening element may be mounted so that the user can rotate it without pulling it out of the handle. Or, it may be mounted in a way that the user can remove it from the handle and reposition the element to expose a different surface, such as by turning, and/or flipping (exchanging ends) the sharpening element to change the grit. Alternatively, the user could simply remove one exchangeable sharpening element and replace it with a different exchangeable sharpening element.

In the selective sharpening embodiments, the user may control the degree to which the knife blade is sharpened. In the fixed mounted selective sharpening exemplary embodiment, the user would control the amount of pressure applied to the side of the knife blade as it passes over the sharpening element. In the moveably mounted selective sharpening exemplary embodiment, the user would control the amount of pressure applied against the push-button. Further, with selective sharpening embodiments, the user may choose to not sharpen the blade at all. Either by applying no lateral pressure on the blade in the case of the fixed mounted embodiment, or by not depressing the push-button in the case of the moveably mounted embodiment during opening and closing.

In contrast to selective sharpening embodiments, non-selective sharpening embodiments would provide a sharpening element that always sharpens the blade as the blade is opened or closed. In non-selective sharpening embodiments, the angled bevel of the blade would pass over the corresponding sharpening element each time the blade is opened or closed. The present invention provides a folding knife comprising a blade, a blade housing having an interior and an exterior, a folding element connecting the blade to the interior of the blade housing, and a sharpening element connected to the interior of the blade housing. In a first exemplary embodiment of the present invention, the interior sharpening element comprises a first sharpening surface element that is connected to a first interior wall of the interior of the blade housing. In the first exemplary embodiment of the present invention, the interior sharpening element further comprises a second sharpening surface element that is connected to a second interior wall of the interior of the blade housing. In the first exemplary embodiment of the present invention, the sharpening surface elements are stationarily connected to the interior walls of the interior of the blade housing.

In a second exemplary embodiment of the present invention, one sharpening surface element would be moveably connected, such as with spring mountings, to the interior wall of the interior of the blade housing and would be activated by depressing a push button corresponding to the respective moveably connected sharpening element.

In a third exemplary embodiment of the present invention, the sharpening element is moveably connected, such as with spring mountings to the interior wall of the interior of the blade housing. One or more springs always press the sharpening element against the blade during the action of opening and closing the knife in a range from zero degrees closed to approximately forty-five degrees opened.

In a fourth exemplary embodiment of the present invention, a portion of the blade is serrated; another portion of the blade is not serrated; the sharpened edge of the serrated portion of the blade would be formed at the intersection of a flat side of the blade with a serrated angled bevel of the blade. In the serrated exemplary embodiment, a portion of the first sharpening surface would correspond in position to the serrated portion of the blade. In the serrated exemplary embodiment, the portion of the first sharpening surface that corresponds in position to the serrated portion of the blade would be contoured to sharpen the serrated portion of the blade. In the serrated exemplary embodiment, the second sharpening surface element would provide a non-serrated-edge-contoured portion corresponding to the non-serrated portion of the blade but would not provide a contoured portion corresponding to the serrated portion of the blade.

It will be understood by someone with ordinary skill in the art that some blades are serrated, and provide no non-serrated edge—the present invention applies equally to such blades but is not separately discussed in detail with respect to such blades herein. Rather, discussion herein is of blades that are non-serrated, or blades that are serrated and with some portion non-serrated—it will be understood by someone with ordinary skill in the art that the latter blades (with both serrated portions and non-serrated portions), could include blades with an all serrated edge and with no non-serrated edge.

In a fifth exemplary embodiment of the present invention, the blade of the knife would be a "Hollow Flat" blade of the present invention. In the exemplary embodiment, a Hollow Flat blade would have a convex side and a flat side, like a chisel ground blade. The edge of the Hollow Flat blade would be formed at the intersection of an angled bevel on the convex side with the flat side; the angled bevel on the convex side would form an angle of approximately thirty degrees in relation to the flat side. The flat side would be hollow grounded. As will be understood by someone with ordinary skill in the art, and as is described in more detail below, hollow grounding of the flat side of the blade would preserve a portion of the flat side adjacent to the edge—the portion of the flat side that remains is referred to herein as a "small raised flat bevel." The edge of a Hollow Flat blade of the present invention may be sharpened either by grinding the small raised flat bevel, or by grinding the angled bevel.

It will be understood by someone with ordinary skill in the art that the description herein of the Hollow Flat blade as having a convex side as well as a flat side is illustrative; other blade profiles in combination with the hollow ground flat side are possible. In all embodiments of a Hollow Flat knife, one side is a hollow ground flat side with a small raised flat bevel; the sharp-edge profile of all Hollow Flat blades will be formed at the intersection of the small raised flat bevel with an angled bevel; the angled bevel side of the Hollow Flat knife blade could be convex, flat, wedge, concave, or other profile variation.

In one exemplary embodiment of the Hollow Flat blade of the present invention, the Hollow Flat blade is used in a folding knife without an Integral Sharpener. In this Hollow Flat blade embodiment, a spacing detent would be provided at the end of the blade opposing the sharp edge of the blade on the hollow ground flat side of the blade. In the exemplary raised edge Hollow Flat blade embodiment, the spacing detent would have exactly the same height as the small raised flat bevel. To sharpen this type of blade, any kind of sharpener may be used.

In one exemplary embodiment of the Hollow Flat blade, a sharpening alignment aperture is disposed in the blade aligned with an exposed sharpening surface of a sharpening element to urge knife blades, such as Hollow Flat blades, inserted through the aperture to be properly positioned on the sharpening element for proper sharpening.

In a second exemplary embodiment of the Hollow Flat blade of the present invention, the Hollow Flat blade is used in a folding knife containing an Integral Sharpener.

Also described below is a method for converting an existing chisel ground knife blade to a Hollow Flat blade.

BRIEF DESCRIPTION OF THE DRAWINGS

These and other features of the present invention are more fully set forth in the following description of exemplary embodiments of the invention. The description is presented with reference to the accompanying drawings in which:

FIG. 1 is a side elevation view of an exemplary non-serrated folding knife blade with a partial side cross-sectional view of an exemplary handle in an exemplary selective sharpening embodiment of the present invention;

FIG. 2 is top plan view of an exemplary non-serrated folding knife blade and corresponding handle of the exemplary selective sharpening embodiment of the present invention;

FIG. 2-1 is a cross-sectional view of the handle of the exemplary selective sharpening embodiment of the present invention depicted in FIGS. 1 and 2;

FIG. 3 is a bottom plan view of an exemplary folding knife in an exemplary embodiment of the present invention;

FIG. 4 is a side elevation view of an exemplary combination non-serrated and serrated folding knife blade with a side cross-sectional view of an exemplary handle in an exemplary selective sharpening embodiment of the present invention;

FIG. 5 is top plan view of the exemplary combination non-serrated and serrated folding knife blade and corresponding handle of the exemplary selective sharpening embodiment of the present invention;

FIG. 6 is a side elevation view of an exemplary combination non-serrated and serrated folding knife blade with a partial side cross-sectional view of an exemplary selective sharpening embodiment of the present invention;

FIG. 8 is a cross-sectional view of an exemplary knife handle and alternative exemplary sharpening elements of the exemplary selective sharpening embodiment of the present invention;

FIG. 9*a* is a top plan view of a spring-mounted non-selective sharpening embodiment of the present invention;

FIG. 9*b* is a cross-sectional view of a handle of a spring-mounted non-selective sharpening embodiment of the present invention;

FIG. 10 is a side elevation view of an exemplary non-serrated chisel ground (single-sided/single bevel) folding knife blade with a partial side cross-sectional view of an exemplary handle in an exemplary spring-mounted non-selective embodiment of the present invention;

FIG. 15*a* is a side elevation view of a combination non-serrated and serrated Hollow Flat folding knife blade, with a partial side cross-sectional view of an exemplary handle, in an exemplary selective sharpening embodiment of the present invention;

FIG. 15*b* is a cross-sectional view of an exemplary combination non-serrated and serrated Hollow Flat folding knife blade, in an exemplary selective sharpening embodiment of the present invention;

FIG. 15*c* a cross-sectional view of an exemplary handle for a combination non-serrated and serrated Hollow Flat folding knife blade, in an exemplary selective sharpening embodiment of the present invention;

FIG. 16 is a top plan view of a combination non-serrated and serrated Hollow Flat folding knife blade and a corresponding handle of an exemplary selective sharpening embodiment of the present invention;

FIG. 17 is a side elevation view of the flat side of a combination non-serrated and serrated Hollow Flat folding knife blade;

FIG. 30*a* is a cross-sectional end view of an exemplary Hollow Flat folding knife blade with an exemplary spacing detent;

FIG. 30*b* is a cross-sectional end view of an alternative exemplary Hollow Flat folding knife blade with an alternative spacing detent;

FIG. 35 depicts a cross-sectional end view of an exemplary knife handle and exemplary multi-sided sharpening element of the exemplary exchangeable sharpening element embodiment of the present invention;

FIGS. 43*a*-43*c* depict cross-sectional end views of an exemplary knife handle, with an exemplary groove for storing an exemplary exchangeable sharpening element in an exemplary sharpening element storage embodiment of the present invention, with an end view of the sharpening element that comprises a substantially square circumference (element 5000' in FIG. 43*a*), a substantially triangular circumference (element 5000" in FIG. 43*b*), and a substantially hexagonal circumference (element 5000'" in FIG. 43*c*).

DETAILED DESCRIPTION OF THE INVENTION

The present invention may be implemented in various embodiments. Several exemplary embodiments are described herein. As will be understood by someone with ordinary skill in the art, other embodiments are possible without departing from the spirit of the present invention. Descriptions herein of materials to be used in the exemplary embodiments are illustrative. As will be understood by someone with ordinary skill in the art, other materials could be used without departing form the spirit of the present invention. For example, the sharpening elements described herein could be made of any material that can be used to sharpen, including, for example, steel, diamond dust, ceramic, or stone; the sharpening elements described herein could comprise sharpening material, such as, for example, steel, diamond dust, or stone, mounted on or bonded to the sharpening elements.

1. Selective Sharpening Embodiments

FIG. 1 is a side elevation view of an exemplary non-serrated folding knife blade 1 with a partial side-cross-sectional view of an exemplary handle 2 in the exemplary selective sharpening embodiment of the present invention. As depicted in FIG. 1, the exemplary non-serrated folding knife blade 1 would have a non-serrated sharp edge 11.

FIG. 2 is top plan view of an exemplary non-serrated folding knife blade 1 and corresponding handle 2 of the exemplary embodiment of the present invention. FIG. 2-1 is a cross-sectional view of the handle of the exemplary selective sharpening embodiment of the present invention depicted in FIGS. 1 and 2.

Figure 7:
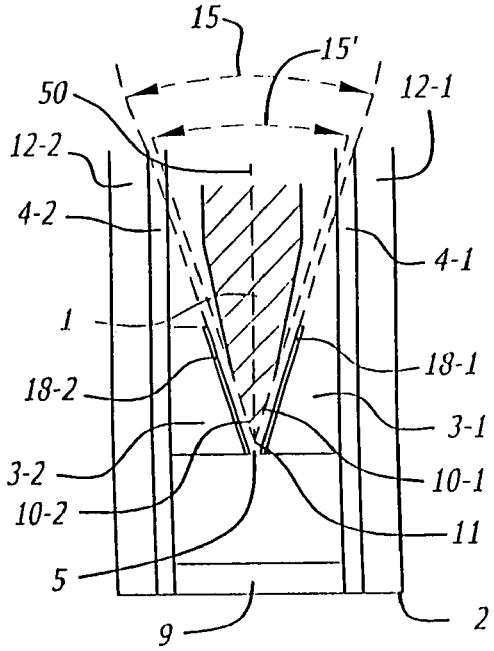
FIG. 7 is a cross sectional view of an exemplary knife handle, exemplary sharpening elements, and an exemplary knife blade of the exemplary selective sharpening embodiment of the present invention.

As depicted in FIG. 2, the exemplary non-serrated knife blade 1 would have a non-serrated sharp edge 11 formed at the union of a first angled bevel 10-1 and a second angled bevel 10-2. The non-serrated sharp edge 11 of the exemplary non-serrated knife blade 1, formed at the union of two angled bevels, 10-1 and 10-2 respectively, is referred to herein as a double-sided edge. As depicted in FIG. 7, the exemplary angled bevels 10-1 and 10-2 would each have, for example, an angle of approximately twenty degrees; the angle 15' formed at the intersection of the two angled bevels 10-1 and 10-2 would be approximately forty degrees.

Figure 27:
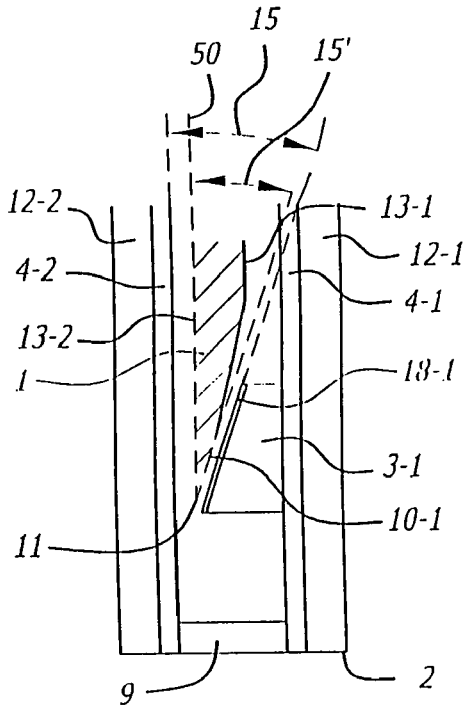
FIG. 27 is a cross-sectional view of an exemplary knife handle, an exemplary sharpening element, and an exemplary chisel ground (single-sided/single bevel) knife blade of an exemplary selective sharpening embodiment of the present invention.

In an alternative embodiment, such as is depicted in FIG. 27, a single-sided edge 11, chisel ground, would be formed by the union of a straight side 13-2/straight bevel 10-2' with a single angled bevel 10-1. As depicted in FIG. 27, the angled bevel 10-1 would form, in the alternative exemplary embodiment, an angle 15' of approximately thirty degrees relative to the straight side 13-2/straight bevel 10-2'. In another alternative embodiment, a blade with a convex side on which is disposed a bevel such as an angled bevel, and a hollow ground side on which is disposed a small raised flat bevel, referred to herein as a "Hollow Flat" blade, would be provided. Exemplary embodiments with "Hollow Flat" blades are depicted in, e.g., FIGS. 15, 16, 17, 18, 19, 20, 21, 22, 23, 24, 25, 26, 28, 29, 31, 36, and 37.

Figure 28:
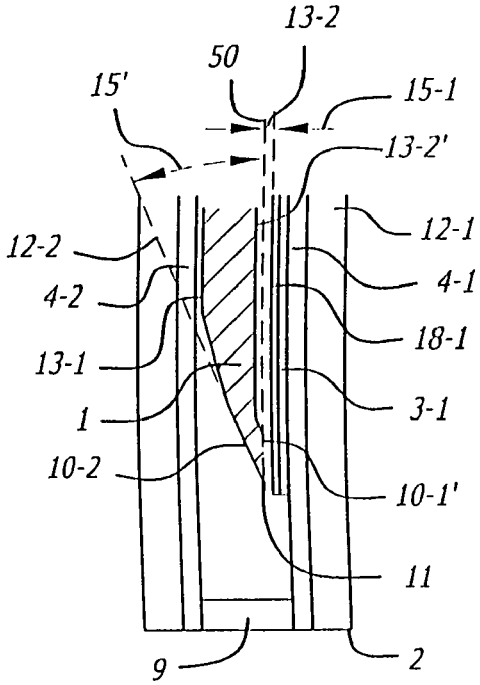
FIG. 28 is a cross-sectional view of an exemplary knife handle, an exemplary sharpening element, and an exemplary Hollow Flat knife blade of an exemplary selective sharpening embodiment of the present invention.

As depicted in, e.g., FIG. 28, a Hollow Flat blade would have a convex side 13-1, and a flat side 13-2. The convex side 13-1 would provide an angled bevel 10-2. In the exemplary embodiment, the angled bevel 10-2 would form an angle of approximately thirty degrees relative to the flat side 13-2. The flat side 13-2 (also sometimes referred to herein as a straight side) would be hollow ground. Hollow grounding the flat side of the exemplary Hollow Flat blade of the present invention would preserve a small raised flat bevel 10-1' of the flat side 13-2 leaving a concave side 13-2'. As someone with ordinary skill in the art will understand and as is discussed in more detail below, a hollow ground "Hollow Flat" blade may be sharpened by applying a sharpening element to the small raised flat bevel 10-1'.

Returning to the exemplary embodiment depicted in FIG. 2, the exemplary handle 2 would provide two exterior grip panels 12-1 and 12-2 respectively. As will be understood by someone with ordinary skill in the art, exterior grip panels 12-1 and 12-2 may be made of a variety of materials, including but not limited to plastic, wood, metal, and other materials.

Continuing with FIG. 2, on the interior of each of the two exterior grip panels 12-1 and 12-2 would be mounted an interior wall 4-1 and 4-2 respectively. As will be understood by someone with ordinary skill in the art, interior walls 4-1 and 4-2 may be made of a variety of materials, including but not limited to various metals, such as steel or aluminum. Further, as will be understood by someone with ordinary skill in the art, construction of a folding knife handle 2 does not mandate that exterior grip panels 12-1 and 12-2 be separate from interior walls 4-1 and 4-2; the handle 2 of a folding knife could be made of a single molded handle body.

Continuing with FIG. 2, a handle base 9 separates interior walls 4-1 and 4-2. As someone with ordinary skill in the art will understand, the handle base 9, as depicted in FIG. 3, would extend the entire length of the back of the handle 2. As will be understood by someone with ordinary skill in the art, construction of a folding knife handle 2 does not mandate that the handle base 9 be separate from exterior grip panels 12-1 and 12-2 and be separate from interior walls 4-1 and 4-2; the handle 2 of a folding knife could be made of a single molded handle body.

Returning to FIG. 2, the handle 2 of the exemplary folding knife would provide an interior blade cavity 6, formed at the sides by the interior walls 4-1 and 4-2, and formed at the end and bottom by the handle base 9.

Continuing with FIG. 2, the sharpening elements 3-1 and 3-2 of the present invention would be mounted to the interior walls 4-1 and 4-2 respectively. As previously mentioned, it will be understood by someone with ordinary skill in the art that the sharpening element may comprise a single piece or multiple pieces; the exemplary selective sharpening embodiment described here depicts two pieces 3-1 and 3-2. The sharpening elements 3-1 and 3-2 of the present invention would be stationarily mounted to the interior walls 4-1 and 4-2 respectively using, for example, epoxy.

As will be understood by someone with ordinary skill in the art, other mounting and/or anchoring means could be used other than epoxy. For example, in FIG. 8, sharpening elements 3-1 and 3-2 would be mounted by piercing handle interior walls 4-1 and 4-2 and mounting sharpening elements 3-1 and 3-2 to the interior walls 4-1 and 4-2 respective with screws 17-1 and 17-2 respectively in the exterior grip panels 12-1 and 12-2.

Returning to FIG. 2, each sharpening element 3-1 and 3-2 would be contoured to correspond and oppose in shape, taper and angulation the corresponding angled bevel 10-1 and 10-2 of the knife blade 1 (see also FIG. 1). As depicted in FIG. 2, in the exemplary selective sharpening embodiment, a sharpening cavity 5 would be formed between the two sharpening elements 3-1 and 3-2. In the exemplary selective sharpening embodiment, the sharpening cavity 5 would be large enough so that if a user does not want to sharpen the blade 1, the user can apply just enough manual pressure to the blade to open or close the blade, as the case may be, and not cause contact between either of the angled bevels 10-1 and 10-2 with either of the corresponding sharpening elements 3-1 and 3-2 respectively.

As depicted in FIG. 2, a folding element 7 would connect the blade 1 to the handle 2. The folding element 7 would allow the blade 1 to be opened from or closed into the handle 2. A lateral wiggle element 8-1 and 8-2 would be provided respectively on each side of the blade 1 around the folding element 7. The lateral wiggle elements 8-1 and 8-2 could be washers made of durable cushion material. A user could apply increased pressure on one or the other side 13-1 or 13-2 of the blade 1 when the blade is being opened or closed; the lateral wiggle elements 8-1 and 8-2 would allow the blade, when such increased pressure is applied, to move into contact with the sharpening element 3-2 or 3-1 respectively opposing the pressure applied. The lateral wiggle elements 8-1 and 8-2 would return the blade 1 to the center of the cavity 5 when application of pressure to a side 13-1 or 13-2 of the blade 1 is stopped.

Some knife blades are serrated, or combine serrated and non-serrated blade edge elements. FIG. 4 is a side elevation view of an exemplary combination non-serrated and serrated folding knife blade 1' with a partial side-cross-sectional view of an exemplary handle in an exemplary selective sharpening embodiment of the present invention. FIG. 5 is top plan view of the exemplary combination non-serrated and serrated folding knife blade and corresponding handle of the exemplary selective sharpening embodiment of the present invention.

As depicted in FIG. 5, the combination non-serrated and serrated folding knife blade 1' comprises a non-serrated edge 11 and a serrated edge 11'; the non-serrated edge 11 would be formed at the union of two angled bevels 10-1 and 10-2; the serrated edge 11' is one-sided.

In the embodiment depicted in FIG. 5, the first sharpening element 3-2 would include a portion 3-2' that corresponds and opposes in contour the serrated portion 10-2' of the angled bevel 10-2 of the serrated edge 11'. The first sharpening element 3-2 further includes a portion 3-2" that corresponds in length to the non-serrated portion 10-2" of the angled bevel 10-2. The second sharpening element 3-1 would correspond in length to the length of non-serrated bevel 10-1 and would not include any portion to correspond to the straight side 10-1*a* of the serrated edge 11'.

FIG. 6 is a side elevation view of a combination non-serrated and serrated folding knife blade 1'. As shown in FIG. 6, an angled bevel 10-2 would provide a non-serrated portion 10-2" and a serrated portion 10-2'. FIG. 6 also depicts a partial side cross sectional view of an exemplary handle 2 of an exemplary selective sharpening embodiment of the present invention. The sharpening element 3-1 would be fixed-mounted (fixably mounted) to the interior wall 4-1 for sharpening only the non-serrated bevel 10-1 (depicted in FIG. 4) of the blade 1'.

FIG. 7 is a cross-sectional view of an exemplary knife handle 2, exemplary sharpening elements 3-1 and 3-2, and a knife blade 1 of the exemplary selective sharpening embodiment of the present invention. As depicted in FIG. 7, sharpening elements 3-1 and 3-2 would have surfaces 18-1 and 18-2 respectively that would be exposed for contact with angled bevels 10-1 and 10-2. Sharpening element surfaces 18-1 and 18-2 may comprise a treated surface of sharpening elements 3-1 and 3-2 respectively, or may comprise sharpening material, such as, for example, diamond dust, applied to, mounted on, or bonded to sharpening elements 3-1 and 3-2. As depicted in FIG. 7, a sharpening cavity 5 would be formed between sharpening elements 3-1 and 3-2. Sharpening elements 3-1 and 3-2 would be counterposed to each other at an angle 15 that corresponds to the angle 15' formed by the two angled bevels 10-1 and 10-2 of the blade 1.

Figure 11:
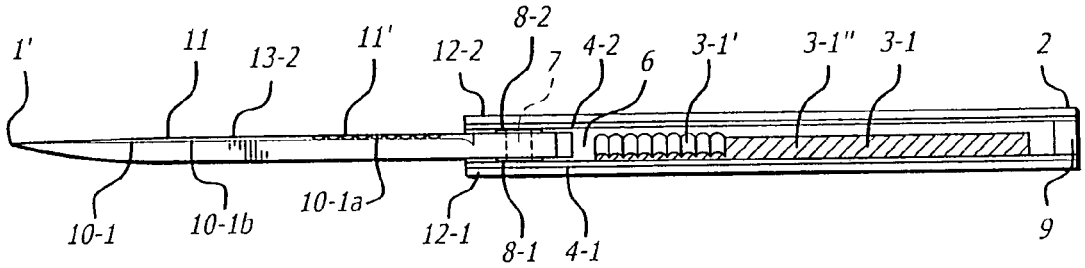
FIG. 11 is a top plan view of an exemplary combination non-serrated and serrated folding knife chisel ground (single-sided/single bevel) blade, and a corresponding handle of the exemplary selective sharpening embodiment of the present invention.

FIG. 11 is a top plan view of an exemplary combination non-serrated and serrated chisel ground (single-sided/single bevel) folding knife blade 1, and a corresponding handle 2 of the exemplary selective sharpening embodiment of the present invention. As depicted in FIG. 11, a sharpening element 3-1 is fixably mounted on only one side of the interior wall—because the blade only has a single-sided (single bevel) edge, only a single sharpening element 3-1 is needed. The sharpening element 3-1 is fixably mounted, such as with a bolt, to the interior wall 4-1. The sharpening element 3-1 of this exemplary combination non-serrated and serrated single bevel blade embodiment would provide a portion 3-1' that corresponds and opposes in contour the serration element 10-1*a* of the angled bevel 10-1 of the serrated edge 11'. The sharpening element 3-1 of this exemplary combination non-serrated and serrated single-sided blade embodiment would provide a portion 3-1" of the sharpening element 3-1 that would correspond in length and position and would oppose in contour and angulation the non-serrated portion 10-1*b* of the angled bevel 10-1.

Figure 12:
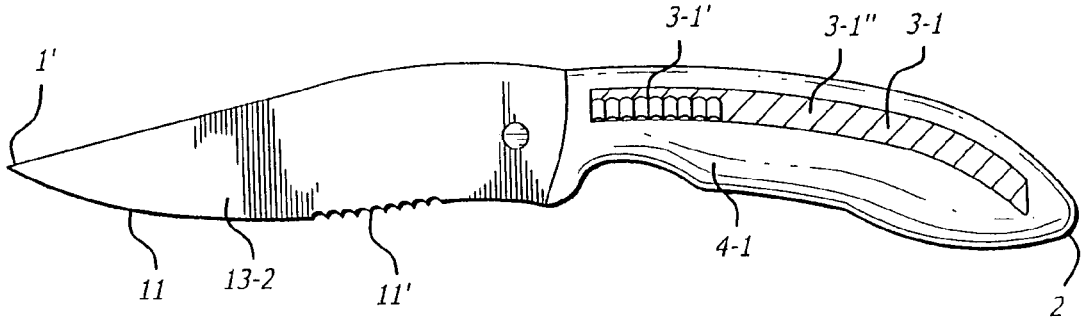
FIG. 12 is a side elevation view of a exemplary combination non-serrated and serrated chisel ground folding knife blade, and a side cross-sectional view of an exemplary handle in an exemplary selective sharpening embodiment of the present invention.

FIG. 12 is a side elevation view of an exemplary combination non-serrated and serrated chisel ground (single-sided/single bevel) folding knife blade 1. In FIG. 12, the blade 1 is shown from the flat side 13-2. There is no angled bevel on the flat side 13-2 of the blade 1. As depicted in FIG. 12, a side cross-sectional view of the exemplary handle shows the sharpening element 3-1 with the two portions 3-1' and 3-1": portion 3-1' would correspond in length and position and would oppose in contour the serrated portion 10-1*a* (shown in FIG. 11) of the angled bevel 10-1 (shown in FIG. 11) in order to sharpen the serrated portion 10-1*a* (shown in FIG. 11) of the edge 11; portion 3-1" would correspond in length and position and would oppose in angle and contour the non-serrated portion 10-1*b* (shown in FIG. 11) of the angled bevel 10-1 (shown in FIG. 11) in order to sharpen the non-serrated portion 10-1*b* (shown in FIG. 11) of the edge 11.

Figure 13:
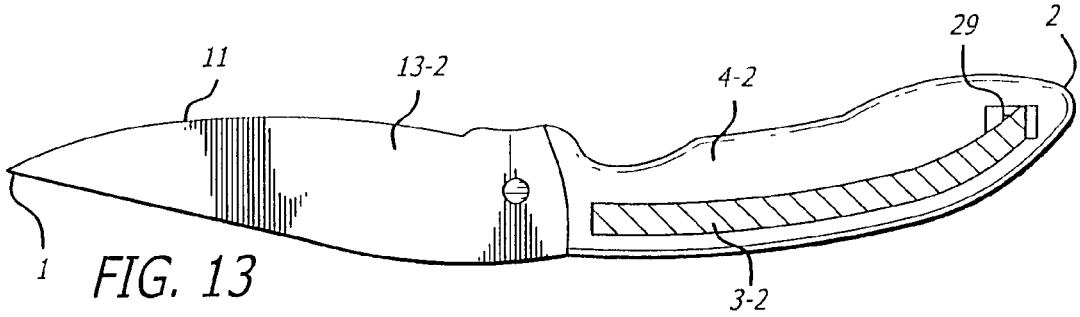
FIG. 13 is a side elevation view of an exemplary non-serrated chisel ground folding knife blade, and a side cross-sectional view of an exemplary handle in an exemplary spring mounted selective sharpening embodiment of the present invention.

FIG. 13 is a side elevation view of an exemplary non-serrated chisel ground single-sided folding knife blade 1, showing the blade 1 from the flat side 13-2. There is no angled bevel on the flat side 13-2 of the blade 1. FIG. 13 shows a side cross-sectional view of the exemplary handle 2 depicting a selective moveably mounted sharpening embodiment of the present invention. In this embodiment, the sharpening element 3-2 would be connected to the interior wall 4-2 with a flexible element 29 such as, e.g., a spring, such as made from bent steel. The flexible element 29 would hold the sharpening element 3-2 away from the blade 1, and would serve as a flex point for the sharpening element 3-2.

Figure 14:
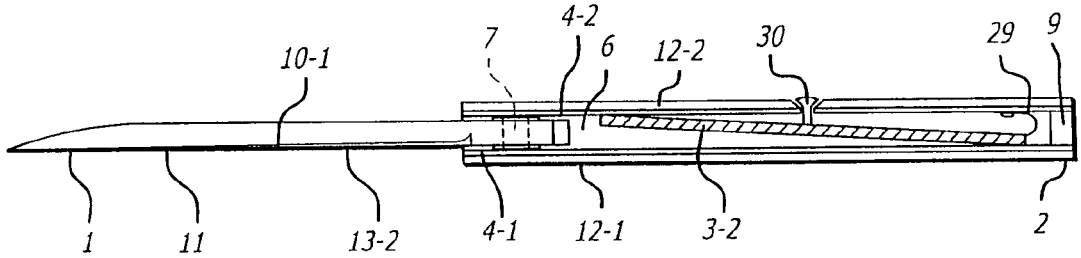
FIG. 14 is a top plan view of an exemplary non-serrated chisel ground folding knife blade and a corresponding handle of the exemplary spring-mounted selective sharpening embodiment of the present invention.

FIG. 14 is a top plan view of an exemplary non-serrated chisel ground single-sided folding knife blade 1, and a corresponding handle 2 as was depicted in FIG. 13. FIG. 14 further provides a top down cross-sectional view of the handle 2 revealing a push button 30 of an exemplary selective flexibly mounted sharpening embodiment of the present invention. As depicted in FIGS. 13 and 14, the flexible element 29 would be mounted on the interior wall 4-2. As depicted in FIG. 14, the flexible element 29 would hold the sharpening element 3-2 at an angle inside the handle 2 and would therefore hold the sharpening element 3-2 away from much of the blade 1. During opening and closing of the knife, as the blade 1 forms an angle relative to the handle 2 in a range between forty-five and zero degrees, the user may apply pressure against the push-button 30, which would press the sharpening element 3-2 against the blade's angled bevel 10-1, thus sharpening the edge 11.

FIG. 15*a* is a side elevation view of a combination non-serrated and serrated Hollow Flat folding knife blade 1. FIG. 15*a* depicts a side-cross-sectional view of the handle 2. The blade 1 depicted in FIG. 15*a* is shown from a convex side 13-1. FIG. 15*a* depicts an angled non-serrated bevel portion 10-2", and an angled serrated bevel portion 10-1'.

FIG. 15*b* depicts a cross-sectional view of blade 1. The cross-sectional view of the blade 1 depicted in FIG. 15*b* shows the angled bevel 10-2 and a small raised flat bevel 10-1' of the concave side 13-2'.

FIG. 15*c* depicts a cross-sectional view of one side 12-2 of handle 2 depicted in FIG. 15*a*. As depicted in FIG. 15*c*, the sharpening element 3-2 is flatly, fixably mounted to the interior wall 4-2. The sharpening surface 18-2 of sharpening element 3-2 depicted in FIG. 15*c* would have a zero degree angle relative to the small raised flat bevel 10-1' (shown in FIG. 15*b*) of the concave side 13-2' (shown in FIG. 15*b*). With reference to FIG. 16, as someone with ordinary skill in the art will understand, hollow grounding of the concave side 13-2' of the blade 1 makes it possible to sharpen the blade by grinding the small raised flat bevel 10-1' of the concave side 13-2' with sharpening surface 18-2. The advantage of using a Hollow Flat blade in this exemplary selective sharpening embodiment of the present invention is that there is only one flat sharpening element and the blade does not require as much lateral wiggle room.

It will be understood by someone with ordinary skill in the art that either side of a Hollow Flat knife blade of the present invention could be hollow ground, and the opposing side to provide an angled bevel. Further, the designation of one or the other sharpening elements 3-1 or 3-2 in the various drawings depicted and described herein as the sharpening element for sharpening one or the other of the bevels of a Hollow Flat blade, or for sharpening the angled bevel of a chisel ground blade, is a design consideration. For example, in FIGS. 28 and 29, sharpening element 3-1 with sharpening surface 18-1 is shown as the sharpening element for grinding the small raised flat bevel 10-1'; in FIGS. 15*a*-25*b*, on the other hand, sharpening element 3-2 with sharpening surface 18-2 is depicted as the sharpening element for grinding the small raised flat bevel 10-1' of a Hollow Flat blade of the present invention.

FIG. 16 is a top plan view of a combination non-serrated and serrated Hollow Flat folding knife blade 1 and a corresponding handle 2 of an exemplary selective sharpening embodiment of the present invention. Because a Hollow Flat blade 1 is used, the sharpening element 3-2 depicted in FIG. 16 always sharpens the edge 11 because the sharpening surface 18-2 of sharpening element 3-2 always grinds against small raised flat bevel 10-1' of the concave side 13-2' including both the small raised flat bevel portion 10-1''' corresponding to the non-serrated portion 10-2" and the small raised flat bevel portion 10-1" corresponding to the serrated portion 10-2' of the blade 1.

FIG. 17 is a side elevation view of the concave side 13-2' of a Hollow Flat blade 1, and shows both the small raised flat bevel portion 10-1''' corresponding to the non-serrated portion 10-2" (shown in FIG. 15*a*) and the small raised flat bevel portion 10-1" corresponding to the serrated portion 10-2' (shown in FIG. 15*a*) of the blade 1.

Figure 18:
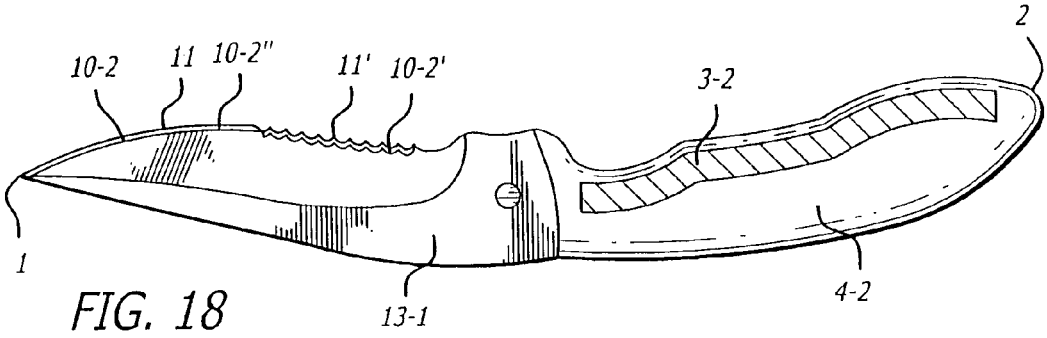
FIG. 18 is a side elevation view of a combination non-serrated and serrated Hollow Flat folding knife blade and a partial side cross-sectional view of an exemplary handle in an exemplary selective fixed mounted sharpening embodiment of the present invention.

FIG. 18 is a side elevation view of a combination non-serrated 11 and serrated 11' edge Hollow Flat folding knife blade 1 depicted from the convex side 13-1 and depicting a partial side cross-sectional view of an exemplary handle 2 in an exemplary selective fixed mounted sharpening embodiment of the present invention. In this embodiment, the sharpening element 3-2 would be straight and flat, (that is, the sharpening surface 18-2 (depicted in FIG. 19) would have an angle of zero degrees relative to the small raised flat bevel 10-1') for the entire length of the sharpening element 3-2. The sharpening element 3-2 depicted in FIG. 18 would sharpen both the small raised flat bevel portion 10-1''' (depicted in FIGS. 19 and 20) corresponding to the non-serrated portion 10-2" (depicted in FIG. 18) and the small raised flat bevel portion 10-1" (depicted in FIGS. 19 and 20) corresponding to the serrated portion 10-2' (depicted in FIG. 18) of the Hollow Flat blade 1.

Figure 19:
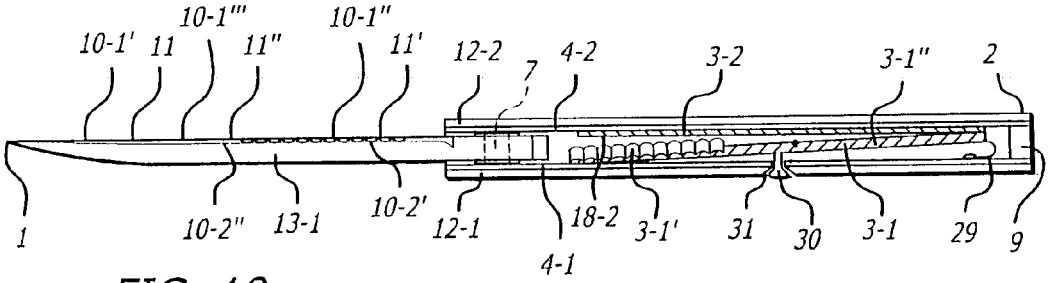
FIG. 19 is a top plan view of a combination non-serrated and serrated Hollow Flat folding knife blade and a corresponding handle of the exemplary selective combination fixed mounted and spring mounted sharpening embodiment of the present invention.

FIG. 19 is a top plan view of a combination non-serrated 11 and serrated 11' Hollow Flat folding knife blade 1 and the corresponding handle 2 of the exemplary selective combination. FIG. 19 depicts sharpening element 3-2 fixably mounted to interior wall 4-2. FIG. 19 depicts sharpening element 3-1, with corresponding serrated-edge sharpening portion 3-1' as moveably, spring mounted to interior wall 4-1 with flexible member 29. FIG. 19 further depicts a top down cross-sectional view of the handle 2, showing a push-button 30. As depicted in FIG. 19, the sharpening element 3-1, with corresponding serrated-edge sharpening portion 3-1', is flexibly connected with flexible member 29, such as a spring made from bent steel, to the interior wall 4-1. A hole 31, through the exterior wall 12-1 and through the interior wall 4-1, would be provided. A push button 30 would be inserted through hole 31 and would be moveably connected to the handle 2. By pressing push button 30, sharpening element 3-1, with its corresponding serrated-edge sharpening portion 3-1', such as by pressing with a thumb or finger, during the opening or closing of the knife blade 1 would cause the sharpening element 3-1, with its corresponding serrated-edge sharpening portion 3-1', to sharpen the corresponding non-serrated angled bevel 10-2" and the corresponding serrated angled bevel 10-2'.

Continuing with FIG. 19, when the knife is closed, sharpening elements 3-2, 3-1' and 3-1 may slightly touch the blade 1 in the closed position. In order to increase sharpening of the edge 11/11', a user could apply lateral pressure against the convex side 13-1 of the blade 1 during opening or closing. However, in the exemplary embodiment depicted in FIGS. 18-20, sharpening of the edge 11/11' will always occur, at least to some extent, because the sharpening surface 18-2 of sharpening element 3-2 always grinds, at least to some extent, small raised flat bevel portion 10-1''' (shown in FIGS. 19 and 20) corresponding to the angled non-serrated bevel 10-2" (shown in FIG. 18) and the small raised flat bevel portion 10-1" (shown in FIGS. 19 and 20) corresponding to the angled serrated bevel 10-2' (shown in FIG. 18). On the opposite side of the blade 13-1 (shown in FIG. 18), the finishing process of knocking off the burr from the angled bevel 10-2" (FIG. 18) and 10-2' (FIG. 18) takes place.

Figure 20:
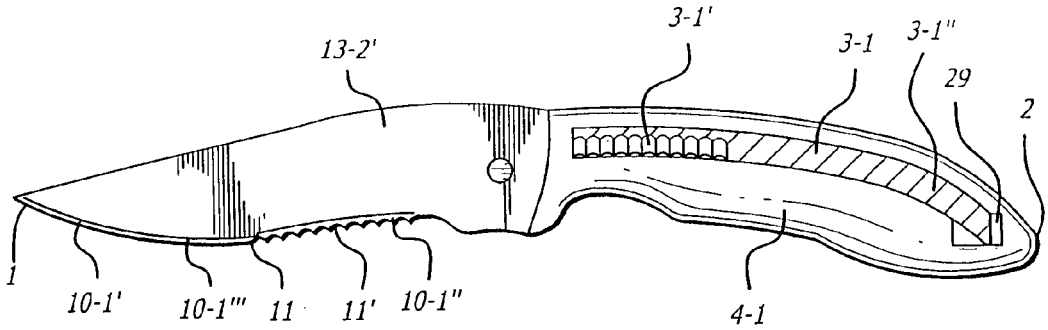
FIG. 20 is a side elevation view of a combination non-serrated and serrated Hollow Flat folding knife blade and a partial side cross-sectional view of an exemplary handle in an exemplary selective spring mounted sharpening embodiment of the present invention.

FIG. 20 depicts the concave side 13-2' of the combination non-serrated and serrated Hollow Flat folding knife blade 1 and a partial cross-sectional view of an exemplary handle 2 of the exemplary selective sharpening embodiment of the present depicted in FIGS. 18 and 19. As depicted in FIG. 20, the moveably connected sharpening element 3-1 is mounted to the interior wall 4-1 with a flexible member 29, such as a spring made from bent steel; flexible member 29 serves as a flex point for sharpening element 3-1. The serration-corresponding portion 3-1' of sharpening element 3-1 would correspond in position and length to, and would oppose in contour, the angled serrated bevel element 10-2' (depicted in FIG. 18) of the serrated edge 11'. The straight portion 3-1" would sharpen the non-serrated portion 10-2" (depicted in FIG. 18) of the angled bevel 10-2 (depicted in FIG. 18).

Figure 24A:
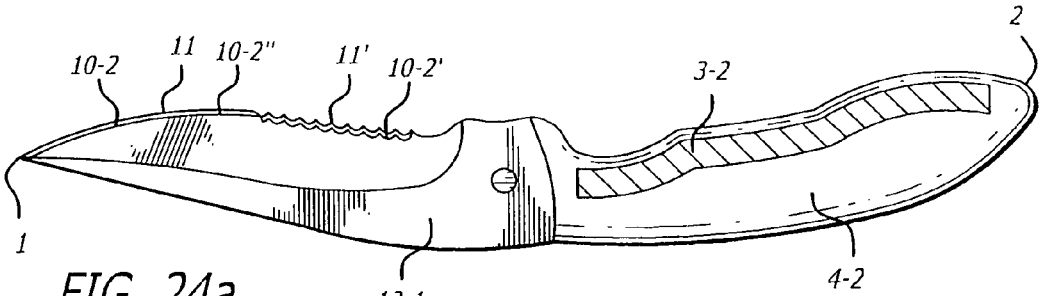
FIG. 24*a* is a side elevation view of an exemplary combination non-serrated and serrated Hollow Flat folding knife blade with a partial side cross-sectional view of an exemplary handle that provides a sharpening element for the flat side of a Hollow Flat folding knife blade (as shown in FIG. 24*a*) and provides a sharpening element (as shown in, e.g., FIGS. 25*a* and 26*a*) for the angled bevel of a Hollow Flat folding knife blade in an exemplary selective sharpening embodiment of the present invention.

FIG. 24*a* is a side elevation view of an exemplary combination non-serrated and serrated Hollow Flat folding knife blade 1 with a partial side cross-sectional view of an exemplary handle 2 that provides a sharpening element 3-2 (as shown in FIG. 24*a*) for the small raised flat bevel 10-1' (shown in FIG. 26*a*) of a Hollow Flat folding knife blade 1 and provides a sharpening element 3-1 (as shown in, e.g., FIGS. 25*a* and 26*a*) for the angled bevel 10-2 (shown in FIG. 24*a*) of a Hollow Flat folding knife blade 1 in an exemplary selective sharpening embodiment of the present invention.

Figure 24B:
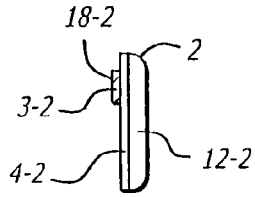
FIG. 24*b* depicts a cross-sectional view of one side of the exemplary handle of the exemplary selective sharpening embodiment of the present invention as depicted in FIGS. 24*a* and 25*a;*
Figure 25A:
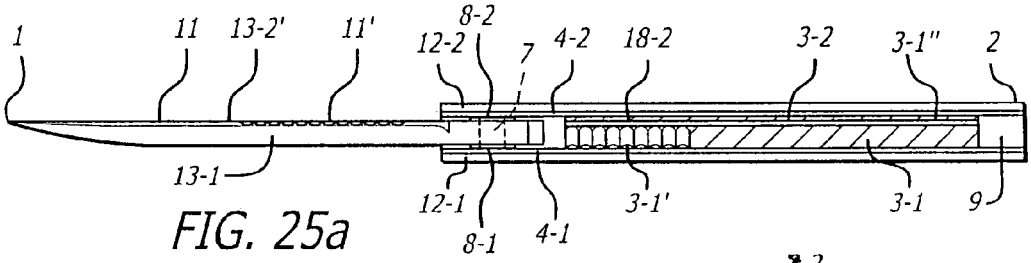
FIG. 25*a* is a top plan view of an exemplary combination non-serrated and serrated edged Hollow Flat folding knife blade and corresponding handle providing sharpening elements for both the flat side of a Hollow Flat folding knife blade and for the angled bevel of a Hollow Flat folding knife blade.

FIG. 24*b* depicts a cross-sectional view of one side (interior wall 4-2 and exterior wall 12-2) of the exemplary handle 2 of an exemplary selective sharpening embodiment of the present invention depicted in FIGS. 24*a* and 25*a*. In the embodiment depicted in FIGS. 24*a* and 24*b*, the sharpening element 3-2 would be mounted straight and flat, so that the sharpening surface 18-2 of sharpening element 3-2 would have a zero degree angle relative to small raised flat bevel 10-1' (shown in FIG. 26*a*) for the entire length of sharpening element 3-2. Therefore, as the knife blade 1 (depicted e.g., in FIG. 24*a*) is opened or closed, sharpening surface 18-2 (depicted in FIGS. 24*b*, 25*a*, and 25*b*) of sharpening element 3-2 (depicted in FIGS. 24*b*, 25*a*, and 25*b*) in the embodiment depicted in FIGS. 24*a* through 26*b* would sharpen edge 11/11' (depicted e.g., in FIG. 24*a*), depending on the pressure applied to the opposing side 13-1 (depicted in FIG. 24*a*) of the blade 1, by causing sharpening surface 18-2 (depicted in FIGS. 24*b*, 25*a*, and 25*b*) to contact the small raised flat bevel portion 10-1''' (depicted in FIG. 26*a*) corresponding to the angled non-serrated bevel 10-2" (depicted in FIG. 24*a*) and the small raised flat bevel portion 10-1" (depicted in FIG. 26*a*) corresponding to the angled serrated bevel 10-2' (depicted in FIG. 24*a*) on the concave side 13-2' (depicted in FIG. 26*a*) of the Hollow Flat blade 1.

FIG. 25*a* is a top plan view of an exemplary combination non-serrated 11 and serrated 11' edged Hollow Flat folding knife blade 1 and corresponding handle 2 that provides sharpening elements for both the small raised flat bevel 10-1' of a Hollow Flat folding knife blade 1 and for the angled bevel 10-2 (shown in FIG. 24*a*) of a Hollow Flat folding knife blade 1.

Figure 25B:
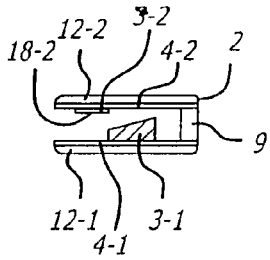
FIG. 25*b* is a cross-sectional view of the handle of the exemplary selective sharpening embodiment of the present invention depicted in FIGS. 24*a* and 25*a;*

FIG. 25*b* is a cross-sectional view of the handle 2 of the exemplary selective sharpening embodiment of the present invention depicted in FIGS. 24*a* and 25*a*. In the embodiment depicted in FIGS. 25*a* and 25*b*, both sharpening elements 3-2, and 3-1' and 3-1, are fixably connected, such as fixed bolt-in, to the respective interior walls 4-1 and 4-2. As depicted in FIG. 25*b*, sharpening element 3-2 is not angled, and would sharpen the small raised flat bevel 10-1' (shown in FIG. 26*a*) of the Hollow Flat folding knife blade 1; sharpening element 3-1 would be angled to correspond to the angulation of the angled bevel 10-2 (shown in FIG. 24*a*) of the convex side 13-1 (shown in FIG. 24*a*) of the Hollow Flat folding knife blade 1.

Figure 26A:
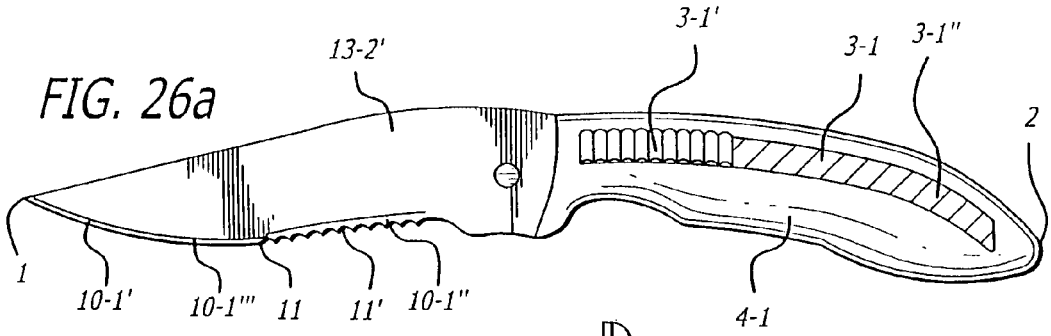
FIG. 26*a* is a side elevation view of the flat side of the combination non-serrated and serrated Hollow Flat folding knife blade and corresponding handle depicted in FIGS. 24*a* and 25*a*, with a partial side cross-sectional view of the corresponding handle 2, depicting a side view of exemplary combination serrated and non-serrated sharpening portions.

FIG. 26*a* is a side elevation view of the flat side 13-1 of the combination non-serrated and serrated Hollow Flat folding knife blade 1 and corresponding handle 2 depicted in FIGS. 24*a* and 25*a*. FIG. 26*a* depicts the small raised flat bevel 10-1' with the non-serrated portion 10-1''' and the serrated portion 10-1''. FIG. 26*a* also depicts a partial side cross-sectional view of the corresponding handle 2, depicting a side view of the combination serrated 3-1' and non-serrated 3-1'' sharpening portions.

Figure 26B:
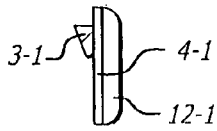
FIG. 26*b* depicts a cross-sectional view of the angled bevel sharpening side of the exemplary handle of the selective sharpening embodiment of the present invention also depicted in FIGS. 25*a* and 26*a;*

FIG. 26*b* depicts a cross-sectional view of one side (interior wall 4-1 and exterior wall 12-1, turned upside down) of the exemplary handle 2 of the selective sharpening embodiment of the present invention depicted in FIGS. 24*a*, 25*a* and 26*a*. The sharpening element 3-1, with the combination serrated 3-1' and non-serrated 3-1'' sharpening portions, would be fixably mounted to interior wall 4-1. Portion 3-1' would be used to sharpen the serrated portion of the edge 10-2' on the convex side 13-1 of the blade 1. Portion 3-1'' would be used to sharpen the non-serrated part of the edge 10-2'' on the convex side 13-1 of the blade 1.

FIG. 27 is a cross-sectional view of an exemplary knife handle 2, an exemplary sharpening element 3-1, and a chisel ground (single-sided/single bevel) knife blade 1 of an exemplary selective sharpening embodiment of the present invention. As depicted in FIG. 27, sharpening element 3-1 would have a surface 18-1 that would be exposed for contact with angled bevel 10-1. Sharpening element surface 18-1 may comprise a treated surface of sharpening element 3-1 or may comprise sharpening material, such as, for example, diamond dust, applied to, mounted on, or bonded to sharpening element 3-1. FIG. 27 depicts a chisel ground (single-sided/single bevel) blade 1 with only a single angled bevel 10-1 on the convex side 13-1 of the blade 1. The angled bevel would have an angle 15 of approximately thirty degrees relative to flat side 13-2. Because the blade 1 would have only a single angled bevel 10-1, only one sharpening element 3-1 is needed. The sharpening element 3-1 would be fixably mounted to the interior wall 4-1 and would have an angle 15' relative to the opposing flat side 13-2 that would correspond to the angle 15 of the angled bevel 10-1.

FIG. 28 is a cross-sectional view of an exemplary knife handle 2, an exemplary sharpening element 3-1, and a Hollow Flat knife blade 1 of an exemplary selective sharpening embodiment of the present invention. FIG. 28 depicts a Hollow Flat blade 1 with an angled bevel 10-2 with approximately a thirty degree angle 15' and a small raised flat bevel 10-1'; the small raised flat bevel 10-1' would have a zero degree angle (parallel to) the centerline 50 of the blade 1. As will be understood by someone with ordinary skill in the art, the edge of the Hollow Flat blade 1 could be sharpened by grinding only the small raised flat bevel 10-1' with flat sharpening element 3-1 which, in the exemplary embodiment, is mounted flat to interior wall 4-1 and has a flat surface that is parallel relative to the small raised flat bevel 10-1'.

Figure 29:
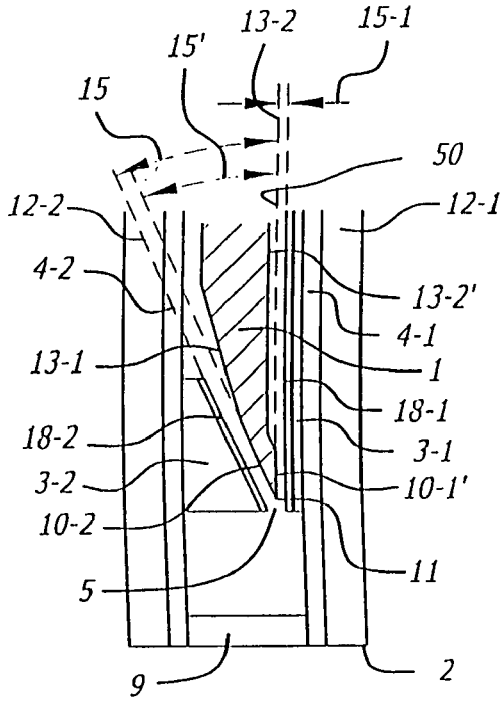
FIG. 29 is a cross-sectional view of an exemplary knife handle, exemplary sharpening elements, and an exemplary Hollow Flat knife blade of an exemplary selective sharpening embodiment of the present invention.

FIG. 29 is a cross-sectional view of an exemplary knife handle 2, exemplary sharpening elements 3-1 and 3-2, and a Hollow Flat knife blade 1 of an exemplary selective sharpening embodiment of the present invention. As depicted in FIG. 29, the Hollow Flat blade 1 would have an angled bevel 10-2 on the convex side 13-1 of the blade 1; the angled bevel 10-2 would have an angle 15' of approximately thirty degrees; opposite the angled bevel 10-2, the blade 1 would provide a small raised flat bevel 10-1'; the small raised flat bevel 10-1' would be parallel relative to the centerline 50 of the blade 1. As depicted in FIG. 29, the sharpening element 3-2 would have an angle 15 which corresponds to the angle 15' of the angled bevel 10-2. The sharpening element 3-1 would have an angle 15-1 of zero degrees with respect to the small raised flat bevel 10-1' of the blade.

Figure 31:
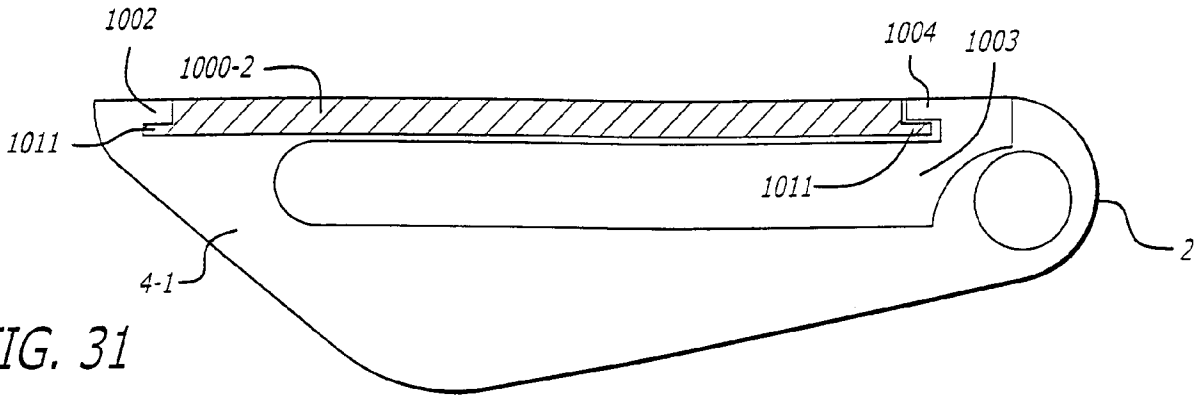
FIG. 31 is a side elevation view of an exemplary exchangeable sharpening element and an exemplary flat spring depicting in cross-section the corresponding knife handle in an exemplary selective sharpening exchangeable sharpening element embodiment of the present invention.

In an exemplary selective sharpening exchangeable sharpening element embodiment of the present invention, an exemplary exchangeable sharpening element 1000-2 as depicted, e.g., in FIG. 31, is provided. The exchangeable sharpening element 1000-2 is removable, and can be exchanged for a new element, or an element with different sharpening characteristics, such as, for example, a different grit. FIG. 31 is a side elevation view of an exemplary exchangeable sharpening element 1000-2 and an exemplary flat spring 1003 depicting in cross-section the corresponding knife handle 2.

With reference to FIGS. 31, and 32*a* through 34*b*, viewed from its end, the exemplary exchangeable sharpening element 1000-2 is an "L"-shaped element that is bent at a ninety degree angle along its longitudinal axis. It will be understood by someone with ordinary skill in the art that the angulation could be varied without departing from the spirit of the present invention. For example, in one alternative embodiment, viewed from its end, the sharpening element is in the shape of an upside-down "U"; the upside-down "U"-shaped element can be attached to one wall of a knife handle by crimping, or other method of fastening, so that the wall of the knife handle to which the element is attached is sandwiched in between the two sides of the "U"-shaped element; the top of the upside down "U" forms an exposed surface along the top edge of the knife handle.

Returning with reference to the exemplary selective sharpening exchangeable sharpening element embodiment, the exemplary exchangeable sharpening element 1000-2 will have two sharpening surfaces 1010 and 1020 as depicted in, e.g., FIGS. 35, 36, 38 and 39.

FIG. 35 depicts a cross-sectional end view of an exemplary knife handle 2 and an exemplary multi-sided sharpening element 1000-2 mounted on wall 4-2 of the handle 2. The exemplary multi-sided sharpening element 1000-2 is constructed at a ninety-degree angle along its longitudinal axis. It provides two sharpening surfaces 1010, 1020. One sharpening surface 1010 faces inside the handle towards the blade when the blade is folded in (see FIGS. 36 and 37 in which the exemplary sharpening element 1000-2 is mounted on wall 4-1 of handle 2). The second sharpening surface 1020 is exposed at the top surface edge of one wall 4-2 of the handle 2. The exterior exposed sharpening surface 1020 can be used for sharpening of objects other than the knife blade (not shown in FIG. 35, but see FIG. 36)) attached to the handle 2, such as for example, a blade of a second knife.

Figure 36:
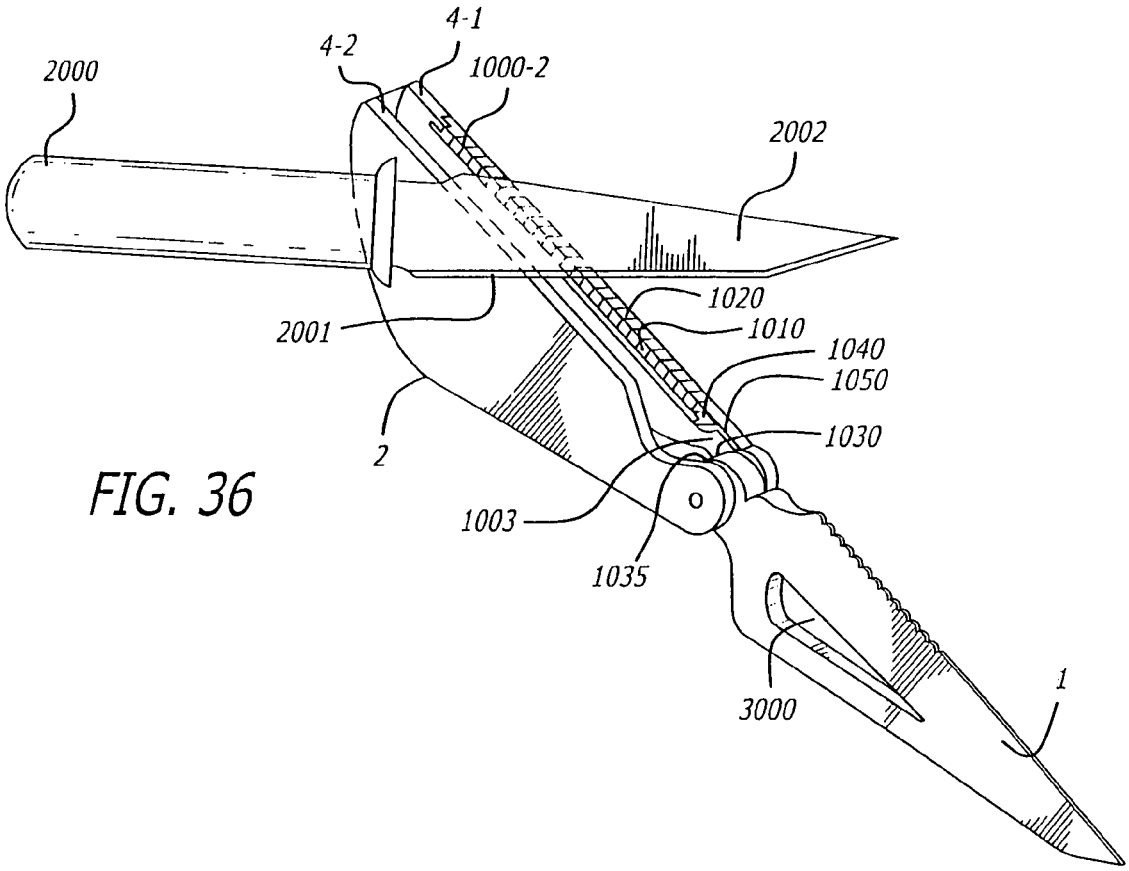
FIG. 36 depicts a perspective view of an exemplary folding knife and an exemplary multi-sided exchangeable sharpening element in an exemplary exchangeable sharpening element embodiment of the present invention with a second knife on an exterior sharpening surface of the exemplary multi-sided exchangeable sharpening element.

FIG. 36 depicts a perspective view of an exemplary folding knife with an exemplary multi-sided exchangeable sharpening element 1000-2 mounted on wall 4-1 of handle 2. In FIG. 36, a second knife 2000 is depicted with its blade bevel 2001 in contact with the exterior exposed sharpening surface 1020 of the exemplary multi-sided exchangeable sharpening element 1000-2. To sharpen the blade 2002 of the second knife 2000, the user applies pressure to, and moves the knife bevel 2001 over, the exterior exposed sharpening surface 1020.

Each sharpening surface 1010, 1020 respectively may have a different sharpening grit. It will be understood by someone with ordinary skill in the art, that in alternative embodiments, an alternative exemplary exchangeable sharpening element could be made with more than two sharpening surfaces, whereby all of the sharpening surfaces could have the same grit, or whereby each sharpening surface could have a different grit, or further, where one or more surfaces could have no grit and could be used for "steeling" a blade.

With reference to, e.g., FIG. 36, when the exemplary exchangeable sharpening element 1000-2 is installed in an exemplary knife handle 2, the exemplary exchangeable sharpening element 1000-2 will be mounted on a wall, in this case wall 4-1, of the exemplary knife handle 2. Either wall 4-1 or 4-2 of a knife handle 2 could be made to be suitable for engaging an exemplary exchangeable sharpening element 1000-2. The wall selected for a particular knife on which the sharpening element 1000-2 will be mounted will be based on factors such as whether the knife is a right-handed or left-handed knife.

Figure 37:
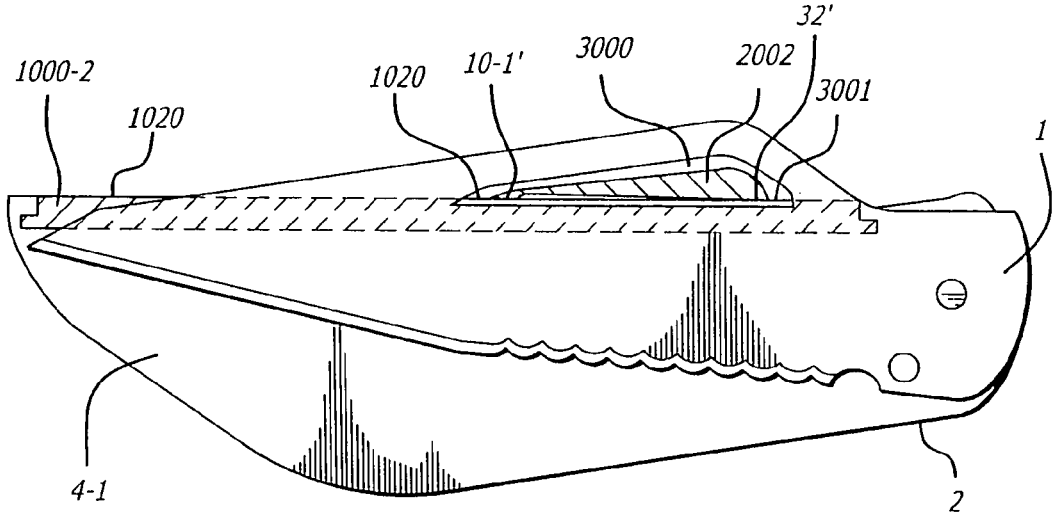
FIG. 37 depicts a side cross-sectional view of an exemplary Hollow Flat folding knife blade, an exemplary interior wall, an exemplary multi-sided exchangeable sharpening element and an exemplary sharpening alignment aperture in an exemplary sharpening alignment aperture embodiment of the present invention.

In the exemplary selective sharpening exchangeable sharpening element embodiment of the present invention, when the exemplary exchangeable sharpening element 1000-2 is installed in an exemplary knife handle 2, one sharpening surface 1010 of the exemplary exchangeable sharpening element 1000-2 will be exposed to the flat side (not shown in FIG. 36, but see elements 13-2' and 10-1' in, e.g., FIG. 17) of a Hollow Flat folding knife blade 1 when that blade is folded into the handle 2 (see also FIG. 37). Continuing with reference to FIG. 36, the other side of the "L"-shaped exemplary exchangeable sharpening element 1000-2 will be seated on the upper exterior edge of the wall, in this case wall 4-1, of knife handle 2, exposing the sharpening surface 1020 of the exemplary exchangeable sharpening element 1000-2 at the upper edge of the housing. The exposed sharpening surface 1020 will be exposed for sharpening blades that are not integral or connected to the exemplary knife handle 2, such as is depicted in FIG. 36.

Exposure of the second sharpening surface 1020 at the top edge of the wall, in this case wall 4-1, on the exterior of the knife handle 2 gives the user the ability to use the exemplary exchangeable sharpening element 1000-2 to sharpen things other than the folding knife blade that is connected to the knife handle 2. For example, additional knives (both fixed and folding blades), fishing hooks, arrowheads, axes, chisels, etc. could be sharpened using the exterior exposed sharpening surface.

It will be understood by someone with ordinary skill in the art that the exterior exposed surface 1020 of the exemplary exchangeable sharpening element 1000-2 is not a limitation of the invention. Rather, in alternative embodiments, the entire sharpening surface(s) of the sharpening element 1000-2 could be completely contained within the knife handle 2. Further, a fixed integral sharpening element, e.g., element 3-2 as depicted in FIG. 1 and described above, could be configured to include an extension having a sharpening surface for exposure at the top edge of one wall, such as wall 4-2, of the knife handle 2.

FIG. 31 depicts a simple, yet effective way, to hold and lock the exemplary exchangeable sharpening element 1000-2 in the knife handle 2. The exemplary exchangeable sharpening element 1000-2 would provide two detents 1011 at each end of the exemplary exchangeable sharpening element 1000-2. The exemplary exchangeable sharpening element 1000-2 is symmetrical; the detents 1011 on each end of the exemplary exchangeable sharpening element 1000-2 are identical so that the sharpening element 1000-2 can be flipped end-to-end.

As depicted in FIG. 31, on one end of one wall of the handle is disposed a first exemplary knife handle detent 1002. To mount the exemplary exchangeable sharpening element 1000-2, the exemplary exchangeable sharpening element detents 1011 would be fitted on either side of and slightly under the exemplary knife handle detent 1002. At the end of the wall 4-1 of the exemplary knife handle 2 opposing the end of the handle 2 at which detent 1002 is provided, an exemplary locking detent 1004, would be provided. The detents 1011 at the end opposite the detents 1011 that had been fitted on either side of knife handle detent 1002 would then be fitted on either side of locking detent 1004. To hold the exemplary exchangeable sharpening element 1000-2 in place, an exemplary flat spring 1003 would be provided. The exemplary flat spring 1003, when in place, would lock the detents on either side of locking detent 1004, and the exemplary exchangeable sharpening element 1000-2, in place. By locking the exemplary exchangeable sharpening element 1000-2 in place, the sharpening element 1000-2 will remain stable when the blade (not shown) is opened or closed.

The exemplary flat spring 1003 would be a flat piece of steel and would be used to lock the blade in a full open position. The exemplary flat spring 1003 would give the user the opportunity to unlock the knife blade and close the knife with only one hand. Flat spring folding knife blade locking mechanisms in various forms have been in commercial use for many years and are a feature included in many folding knives manufactured today.

Figure 38:
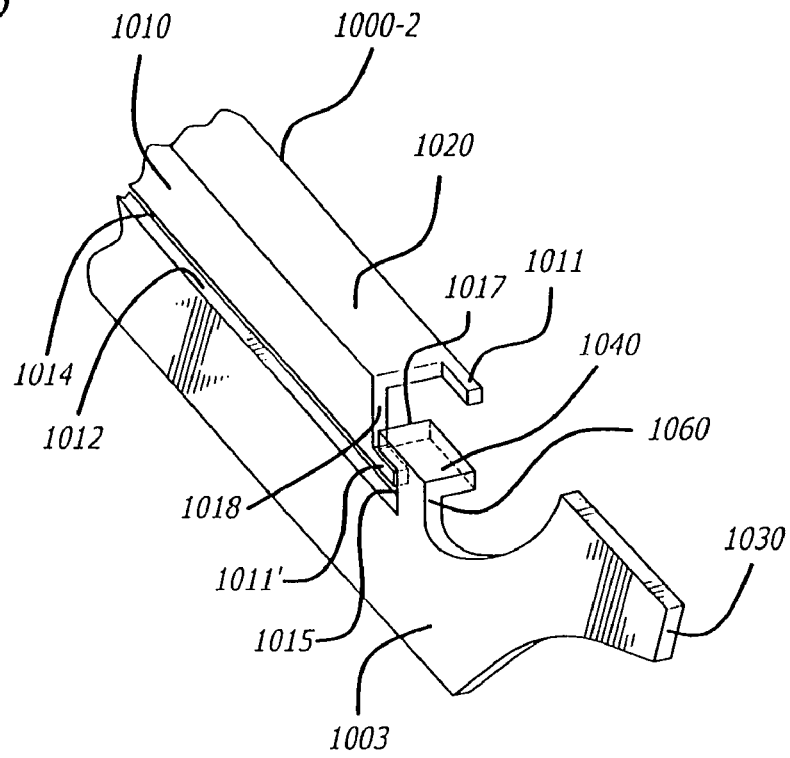
FIGS. 38 and 39 depict enlarged perspective partial views of an exemplary sharpening element and an exemplary flat spring in an exemplary selective sharpening exchangeable sharpening element embodiment of the present invention.
Figure 39:
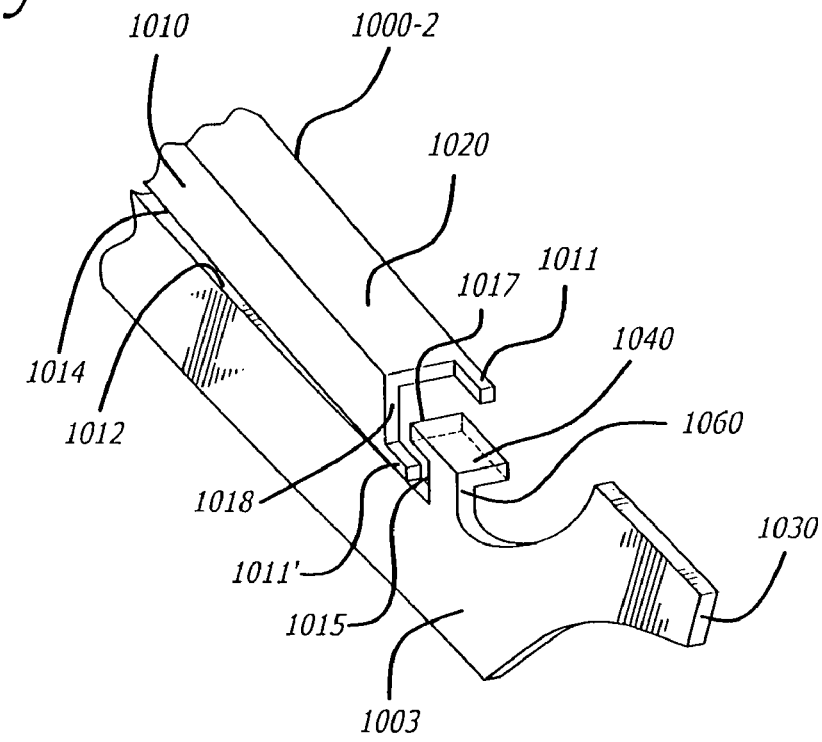

FIGS. 38 and 39 depict enlarged perspective partial views of an exemplary sharpening element 1000-2 and an exemplary flat spring 1003 in an exemplary selective sharpening exchangeable sharpening element embodiment of the present invention. The exemplary flat spring 1003 of the exemplary selective sharpening exchangeable sharpening element embodiment of the present invention provides a blade-locking portion 1030. The blade-locking portion 1030 can be used to engage a blade locking portion 1035 on a folding knife blade 1 as depicted in FIGS. 36 and 40*a* through 40*c*.

Continuing with FIGS. 38 and 39, the exemplary flat spring 1003 of the exemplary selective sharpening exchangeable sharpening element embodiment of the present invention also provides a sharpening element locking arm 1060 with a back edge 1015 and a sharpening element locking hand 1040. The exemplary sharpening element locking arm 1060 vertically extends above a backbone 1012 of the exemplary flat spring 1003. When the exemplary flat spring 1003 is installed in the exemplary knife handle 2, the backbone 1012 should be aligned slightly below the lowest edge 1014 of the installed sharpening element 1000-2; the back edge 1015 of the arm 1060 should be aligned so that it is in front of and clears the front-most edge of the locked detent 1011' mounted on the interior wall 4-1 of the handle 2. When the exemplary flat spring 1003 is installed in the exemplary knife handle 2, the sharpening element locking arm 1060 has a height, the height being sufficient so that the hand 1040 disposed at the top of the arm 1060 is slightly higher than the top-most edge of the locked detent 1011' mounted on the interior wall 4-1 of the handle 2. The exemplary hand 1060 is disposed at the top of the exemplary arm 1040 at a ninety-degree angle to the arm 1040. The exemplary hand 1060 has a back edge 1017. When the exemplary flat spring 1003 is installed in the exemplary knife handle 2, and when the spring 1003 is in a detent locking position, the back edge 1017 of the hand 1060 engages the wall 1018 of the indentation in the sharpening element 1000-2 that is formed between the two detents 1011' and 1011; the bottom of the hand 1060 may rest on the top of the locked detent 1011'.

Figure 40C:
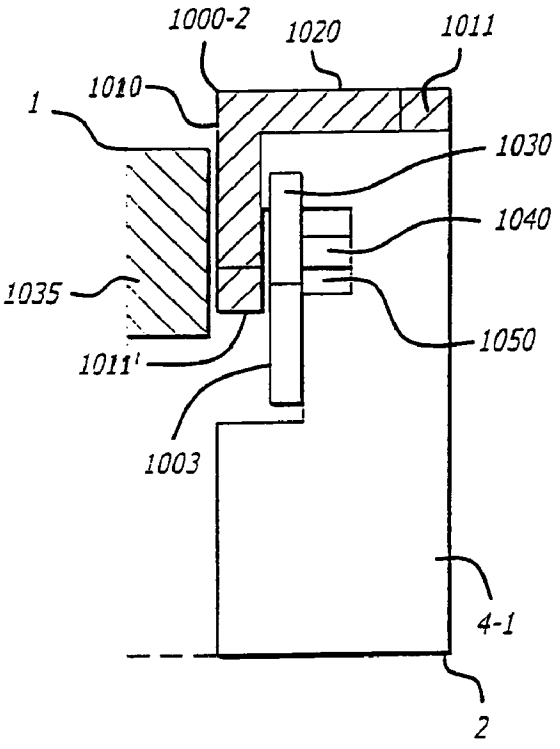
FIGS. 40*a*, 40*b*, and 40*c* are cross-sectional views of a wall of an exemplary handle in an exemplary selective sharpening exchangeable sharpening element embodiment of the present invention in which an exemplary sharpening element is installed.
Figure 40B:
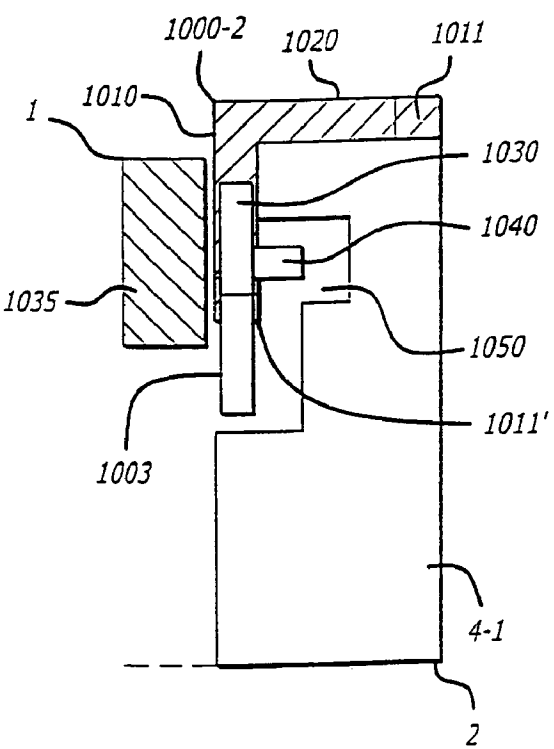
Figure 40A:
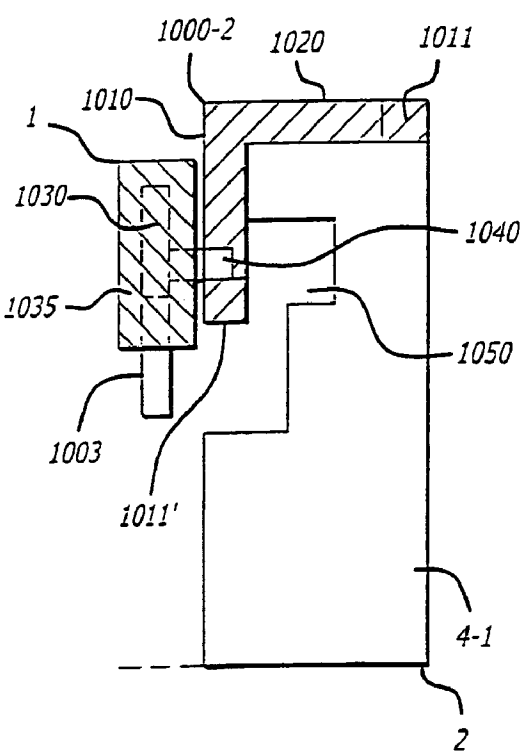

An exemplary indentation 1050 is formed in the interior wall, in this case wall 4-1, of the exemplary handle 2 of the exemplary selective sharpening exchangeable sharpening element embodiment of the present invention on which the sharpening element 1000-2 is mounted. The exemplary indentation 1050 is shaped to receive the arm 1040 and hand 1060 of the spring 1003 when the spring is pressed to unlock the blade, and or the blade and the sharpening element 1003. FIGS. 40*a*, 40*b*, and 40*c* are cross-sectional views of a wall 4-1 of an exemplary handle 2 in an exemplary selective sharpening exchangeable sharpening element embodiment of the present invention in which an exemplary sharpening element 1000-2 is installed. In FIG. 40*a*, the exemplary spring 1003 is in a position for locking a blade (depicted in FIGS. 40*a* through 40*c* as blade locking portion 1035) and sharpening element 1000-2. In FIG. 40*b*, the exemplary spring 1003 is in a position unlocking the blade (depicted in FIGS. 40*a* through 40*c* as blade locking portion 1035) and locking sharpening element 1000-2. In FIG. 40*c*, the exemplary spring 1003 is in a position unlocking both the blade (depicted in FIGS. 40*a* through 40*c* as blade locking portion 1035) and the sharpening element 1000-2. The depth of the indentation 1050 could vary. In the exemplary embodiment, it will be approximately 5 millimeters at its widest expanse. However, the depth of the indentation 1050 could be varied depending on the width of the blade, the sharpening element and the locking spring used.

If a user wants to unlock the exemplary exchangeable sharpening element 1000-2, the user simply applies increased pressure to the exemplary flat spring 1003, so that the exemplary locking arm 1060 and hand 1040 are depressed into the handle indentation 1050, no longer engaging the exemplary sharpening element locking detent 1011' on the wall 4-1 of exemplary knife handle 2, thereby allowing the exemplary exchangeable sharpening element 1000-2 to be removed.

Figure 32B:
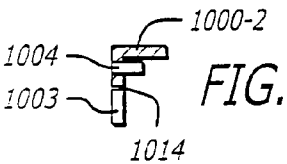
FIGS. 32*a* and 32*b* depict a top elevation view and a cross-sectional end view respectively of an exemplary exchangeable sharpening element and an exemplary flat spring in an exemplary selective sharpening exchangeable sharpening element embodiment of the present invention depicting such that the exemplary flat spring is positioned to allow unlocking of a Hollow Flat folding knife blade (not depicted) and locking of the exemplary exchangeable sharpening element.
Figure 32A:
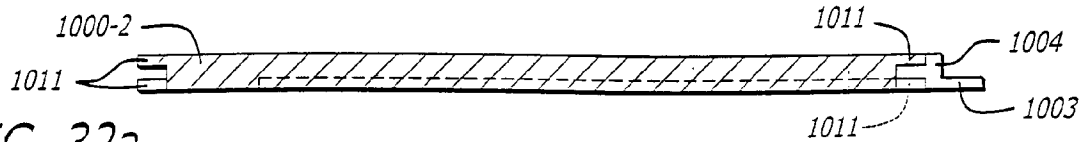

FIGS. 32*a* and 32*b* depict a top elevation view and a cross-sectional end view respectively of an exemplary exchangeable sharpening element 1000-2 and an exemplary flat spring 1003 in an exemplary selective sharpening exchangeable sharpening element embodiment of the present invention. In FIGS. 32*a* and 32*b*, the exemplary flat spring 1003 is positioned to allow unlocking of a Hollow Flat folding knife blade (not depicted) and to lock the exemplary exchangeable sharpening element 1000-2.

Figure 33B:
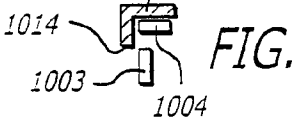
FIGS. 33*a* and 33*b* depict a top elevation view and a cross-sectional end view respectively of an exemplary exchangeable sharpening element and an exemplary flat spring in the exemplary exchangeable sharpening element embodiment of the present invention depicting an exemplary flat spring in a position allowing unlocking of a Hollow Flat folding knife blade (not depicted) and unlocking of an exemplary exchangeable sharpening element.
Figure 33A:
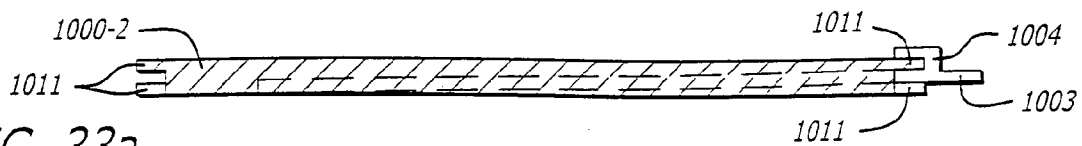

FIGS. 33*a* and 33*b* depict a top elevation view and a cross-sectional end view respectively of an exemplary exchangeable sharpening element 1000-2 and an exemplary flat spring 1003 in the exemplary exchangeable sharpening element embodiment of the present invention. In FIGS. 33*a* and 33*b*, the exemplary flat spring 1003 is in a position that allows unlocking of a Hollow Flat folding knife blade (not depicted) and unlocking of an exemplary exchangeable sharpening element 1000-2.

Figure 34B:
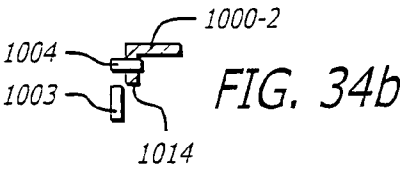
FIGS. 34*a* and 34*b* depict a top elevation view and a cross-sectional end view respectively of an exemplary exchangeable sharpening element and an exemplary flat spring in the exemplary exchangeable sharpening element embodiment of the present invention allowing locking of both a Hollow Flat folding knife blade (not depicted) and an exemplary exchangeable sharpening element.
Figure 34A:
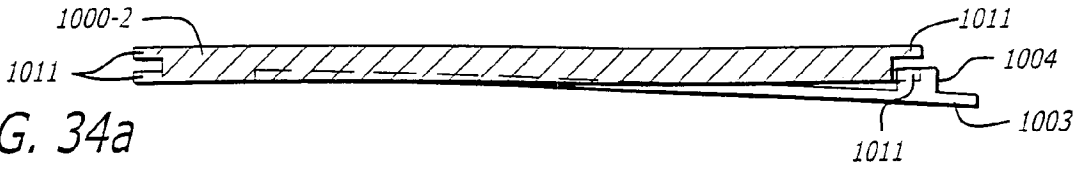

FIGS. 34*a* and 34*b* depict a top elevation view and a cross-sectional end view respectively of an exemplary exchangeable sharpening element 1000-2 and an exemplary flat spring 1003 in the exemplary exchangeable sharpening element embodiment of the present invention. In FIGS. 34*a* and 34*b*, the exemplary flat spring 1003 is positioned to allowing locking of both a Hollow Flat folding knife blade (not depicted) and the exemplary exchangeable sharpening element 1000-2.

It will be understood by someone with ordinary skill in the art that the exemplary approach described here for engaging the exemplary exchangeable sharpening element 1000-2 to the knife handle 2 using sharpening element detents 1011, handle detent 1002, a locking detent 1004, and a flat spring 1003 is exemplary and non-limiting. Other methods of engaging and releasing a sharpening element in a folding knife handle are possible without departing from the spirit of the invention.

In the exemplary selective sharpening exchangeable sharpening element embodiment of the present invention, a sharpening alignment aperture 3000 is formed in the blade 1 as depicted in FIGS. 36 and 37. FIG. 37 depicts a side cross-sectional view of an exemplary Hollow Flat folding knife blade 1, an exemplary interior wall 4-1, an exemplary multi-sided exchangeable sharpening element 1000-2 and an exemplary sharpening alignment aperture 3000. The sharpening alignment aperture 3000 can be used for one-handed opening of the folding knife blade 1. Further, the sharpening alignment aperture 3000 is specifically designed for receiving the insertion of a second Hollow Flat knife blade 2002 (shown as a cross-sectional end view) in order to guide the raised flat bevel 10-1' and spacing detent (in this case, 32') (see also elements 13-2' and 10-1' in, e.g., FIG. 17) of the second blade 2002 across the exterior exposed sharpening surface 1020 of the exemplary multi-sided exchangeable sharpening element 1000-2.

As depicted in FIG. 37, when the knife blade 1 is closed, the exemplary sharpening alignment aperture 3000 provides an alignment surface 3001. The exemplary alignment surface 3001 is aligned with the exterior exposed sharpening surface 1020 of the exemplary multi-sided exchangeable sharpening element 1000-2. As depicted in FIG. 37, when a Hollow Flat blade 2002 (depicted in FIG. 37 in cross-section from an end view) is inserted in the exemplary sharpening alignment aperture 3000 so that the raised flat bevel 10-1' and the spacing detent 32' of the Hollow Flat blade 2002 are even with and against the exemplary alignment surface 3001, the raised flat bevel 10-1' of the Hollow Flat blade will be guided to be even with and flush against the exterior exposed sharpening surface 1020 of the exemplary multi-sided exchangeable sharpening element 1000-2. Such alignment will position the blade 2002 for proper sharpening.

2. Non-Selective Sharpening Embodiments

FIG. 9*a* is a top plan view of a spring-mounted non-selective sharpening embodiment of the present invention. As depicted in FIG. 9*a*, the sharpening element 3-1 would be moveably mounted to the interior wall 4-1 with a main flexible element 25, such as a spring made of bent steel. Flexible element 25 would serve as a flex point for the sharpening element 3-1. As depicted in FIG. 9*a*, two support springs 26, between interior wall 4-1 and the sharpening element 3-1, would be provided. Support springs 26 could be attached to interior wall 4-1, or alternatively, to the side of the sharpening element 3-1 nearest interior wall 4-1. In FIG. 9*a*, the sharpening element 3-1 is depicted at rest. As depicted in FIG. 9*a*, when the sharpening element 3-1 is at rest, there is no space between the sharpening element 3-1 and the interior wall 4-2. When a knife blade is inserted between the sharpening element 3-1 and the interior wall 4-2, the insertion of the knife blade would separate the sharpening element 3-1 from the interior wall 4-1 and support springs 26 would be compressed (as depicted in FIG. 9*b*); flexible element 25 would be temporarily deformed. When the knife blade is withdrawn from between the sharpening element 3-1 and the interior wall 4-2, support springs 26 would decompress and flexible element 25 would return to its at-rest position, returning the sharpening element 3-1 to its' respective at-rest position as depicted in FIG. 9*a*. In FIG. 9*a*, there are two spacers 27 depicted that would be mounted on the sharpening element 3-1, and one spacer 28 that would be mounted on the interior wall 4-1. Mounting of spacers 27 and 28 could be done in various ways, including, e.g., by being bolted in to the sharpening element 3-1 and interior wall 4-1 respectively.

When a knife blade is inserted between the sharpening element 3-1 and the interior wall 4-2, both the main flexible member 25 and the support springs 26 would serve to press the sharpening element 3-1 against the blade 1; the spacers 27 and 28 will hold the sharpening element 3-1 at a distance equivalent to the width of the spacers 27 and 28 from the interior wall 4-1, making it possible to use the sharpener like a fixed mounted selective embodiment of the present invention. Spacers 27 and 28 may also be used to hold the support springs.

FIG. 10 is a side elevation view of an exemplary non-serrated chisel ground single-sided folding knife blade with a partial side cross sectional view of an exemplary handle in an exemplary spring-mounted non-selective embodiment of the present invention.

3. Combination Selective and Non-Selective Sharpening Embodiments

Figure 21:
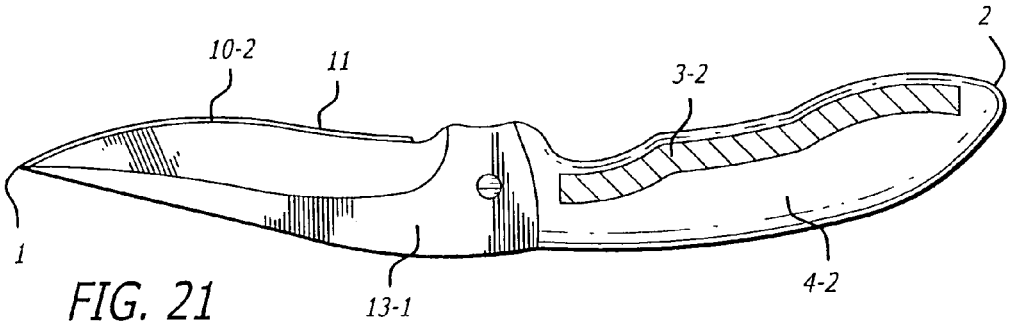
FIG. 21 is a side elevation view of an exemplary non-serrated Hollow Flat folding knife blade with a partial side cross-sectional view of an exemplary handle in an exemplary combination selective and non-selective sharpening embodiment of the present invention.

FIG. 21 is a side elevation view of an exemplary non-serrated Hollow Flat folding knife blade 1, showing the blade from the convex side 13-1, with a partial side cross-sectional view of an exemplary handle 2 in an exemplary combination selective and non-selective sharpening embodiment of the present invention. In the embodiment depicted in FIG. 21, the sharpening element 3-2 would be fixably mounted on the interior wall 4-2 for sharpening the small raised flat bevel 10-1' (shown in FIG. 23). The sharpening element 3-2 would be straight and flat (with a zero degree angle respective to the small raised flat bevel 10-1' (shown in FIG. 23)) in order to sharpen the small raised flat bevel 10-1' (shown in FIG. 23) on the concave side 13-2' (depicted in FIG. 23).

Figure 22A:
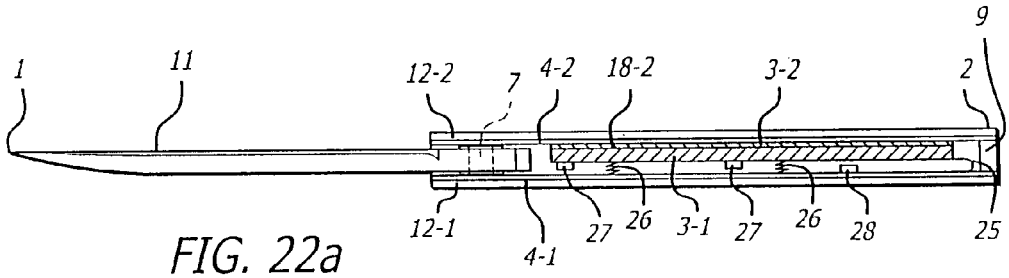
FIG. 22*a* is a top plan view of an exemplary non-serrated Hollow Flat folding knife blade and corresponding combination selective and non-selective sharpening handle also depicted in FIGS. 21 and 23.
Figure 22B:
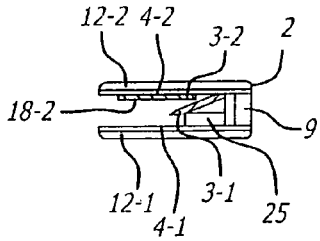
FIG. 22*b* is a cross sectional view of an exemplary handle of the exemplary combination selective and non-selective sharpening embodiment of the present invention depicted in FIGS. 21, 22*a*, and 23.
Figure 23:
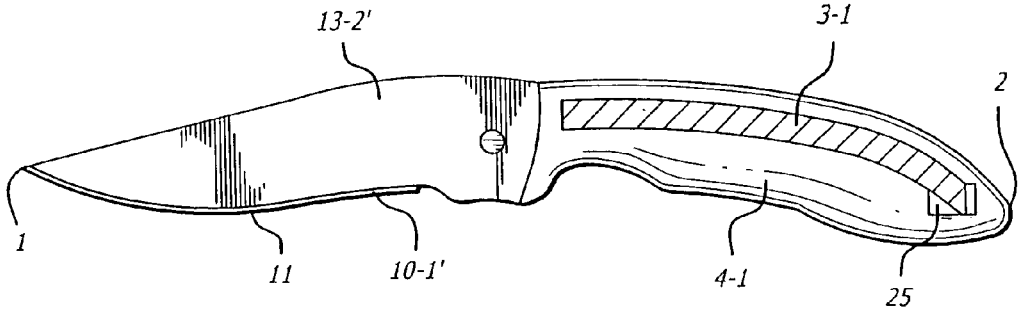
FIG. 23 is a side elevation view of an exemplary non-serrated Hollow Flat folding knife blade with a partial side cross-sectional view of an exemplary handle and an exemplary selective and non-selective spring mounted sharpening embodiment of the present invention.

FIG. 22*a* is a top plan view of the exemplary non-serrated Hollow Flat folding knife blade 1 and corresponding combination selective and non-selective sharpening handle 2 also depicted in FIGS. 21 and 23. FIG. 22*b* is a cross sectional view of an exemplary handle of the exemplary combination selective and non-selective sharpening embodiment of the present invention depicted in FIGS. 21, 22*a* and 23.

As depicted in FIG. 22*a*, sharpening element 3-1 would be flexibly mounted, in a manner similar to that described above in connection with FIG. 9*a*. Because of the flexible mounting of sharpening element 3-1, element 3-1 would always grind angled bevel 10-2 of the chisel ground (single-sided/single bevel) blade 1 depicted in FIGS. 21-23. As with the embodiment depicted in FIG. 9*a*, the sharpening element 3-1 depicted in FIGS. 22*a*-23 would be flexibly mounted, such as with flexible member 25 (such as a spring made from bent steel) that would be mounted to interior wall 4-1; mounting of flexible member 25 to interior wall 4-1 could be done, e.g., by bolting flexible member 25 to interior wall 4-1. Flexible member 25 would serve as a flex point for the sharpening element 3-1.

As shown in FIG. 22*a*, two support springs 26, located between the interior wall 4-1 and the sharpening element 3-1, would be provided. Support springs 26 could be attached to interior wall 4-1, or alternatively, to the side of the sharpening element 3-1 nearest interior wall 4-1. In FIG. 22*a*, the sharpening element 3-1 is depicted at rest. When a knife blade is inserted between the sharpening element 3-1 and the sharpening element 3-2, the insertion of the knife blade would separate the sharpening element 3-1 from the sharpening element 3-2; support springs 26 would be compressed and flexible element would be deformed. When the knife blade 1 is withdrawn from between the sharpening element 3-1 and the sharpening element 3-2, flexible member 25 and support springs 26 would return to their respective at-rest positions, thereby returning the sharpening element 3-1 to its' respective at-rest position as depicted in FIG. 22*a*.

In FIG. 22*a*, there are two spacers 27 mounted, such as, e.g., by being bolted in, on the sharpening element 3-1, and one spacer 28 mounted on the interior wall 4-1. Both the flexible member 25 and the support springs 26 would press the sharpening element 3-1 against the angled bevel 10-2 (shown in FIG. 21) of the blade 1. The spacers 27 and 28 would hold the sharpening element 3-1 in a position a distance equivalent to the width of the spacers 27 and 28 from the interior all 4-1 to which the sharpening element 3-1 is mounted (see FIG. 22*b*). In its compressed state, such as is depicted in cross-section in FIG. 22*b*, sharpening element 3-1 could be used like a fixably-mounted selective sharpening embodiment of the present invention. Spacers 27 and 28 may also be used to hold the support springs.

In order to sharpen the edge 11, the user may apply lateral pressure against the convex side of the blade 13-1 (shown in FIG. 21) during opening and/or closing so that the sharpening surface 18-2 (shown in FIGS. 22*a* and 22*b*) would grind the small raised flat bevel 10-1' (shown in FIG. 23) on the concave side 13-2' (shown in FIG. 23). On the opposite, convex side of the blade 13-1 (shown in FIG. 21), the finishing process of knocking off the burr from the angled bevel 10-1' (shown in FIG. 23) would take place.

FIG. 23 depicts the concave side 13-2' of a non-serrated Hollow Flat folding knife blade 1 in the combination selective and non-selective embodiment depicted in FIGS. 21, 22*a* and 22*b*. As depicted in FIG. 23, is the Hollow Flat blade 1 would provide a non-serrated small raised flat bevel 10-1'. FIG. 23 also depicts a partial cross sectional view of the exemplary handle 2 of the exemplary combination selective and non-selective sharpening embodiment of the present invention.

4. Further Exemplary Blades

As described above, the present invention provides a blade, referred to herein as the "Hollow Flat blade." The Hollow Flat blade would make sharpening much easier, by eliminating the problem of correctly holding the blade to match the angle of the sharp-edge bevel during the sharpening process.

In one exemplary embodiment of the Hollow Flat blade of the present invention, the Hollow Flat blade is used in a folding knife without an Integral Sharpener. As depicted in FIG. 30*a*, in this Hollow Flat blade embodiment, a spacing detent 32 would be provided on the hollow ground flat side of the blade at the end opposing the sharp edge 11 (or in some embodiments with serrated and non-serrated edges, 11/11') of the blade 1. In the exemplary embodiment of the Hollow Flat blade with the spacing detent 32, the spacing detent 32 would be equal in height to the small raised flat bevel 10-1' relative to the concave side 13-2'. As depicted in FIG. 30*a*, in the exemplary raised edge Hollow Flat blade embodiment, the spacing detent 32 would be even with the height of the small raised flat bevel 10-1 relative to line 34-34 as the small raised flat bevel.

To sharpen this type of blade, any kind of sharpener may be used. For example, all kinds of field sharpeners, including sticks or flat types; also sharpeners in the form of a flat plate or block may be used. During the sharpening process of a conventional blade (non-Hollow Flat blade), a user must always match the angle of the angled bevel 10-2, which in the case of an angled bevel, is usually twenty to thirty degrees. In contrast, the zero degree angle of the small raised flat bevel 10-1' of a Hollow Flat blade is very easy to maintain. That is because the small raised flat bevel 10-1' of a Hollow Flat blade is in equal contact with the sharpener, such as e.g., along line 34-34, at both the small raised flat bevel 10-1' and the spacing detent 32. The contact of both the small raised flat bevel 10-1' and the spacing detent 32 with a sharpening surface, such as e.g., along line 34-34, ensures that the zero degree angle of the small raised flat bevel 10-1' is always maintained. In embodiments in which the Hollow Flat blade is made without a spacing detent 32, any kind of spacer may be used on the sharpening device to assist in matching the zero degree angle.

In the exemplary embodiment, as described previously above, a Hollow Flat blade, including those embodiments with a spacing detent 32, would have a convex side 13-1 and a flat side 13-2. The edge 11 (or in some embodiments with serrated and non-serrated edges, 11/11') of the Hollow Flat blade 1 would be formed at the intersection of the angled bevel 10-2 on the convex side 13-1 with the small raised flat bevel 10-1 on the flat side 13-2; the angled bevel 10-2 on the convex side 13-1 would form an angle of approximately thirty degrees in relation to the flat side 13-2.

The flat side 13-2 would be hollow grounded to form a concave side 13-2'. As will be understood by someone with ordinary skill in the art, and as is described in more detail below, hollow grounding of the flat side 13-2 of the blade 1 would preserve a portion of the flat side adjacent to the edge—the portion of the flat side that remains is referred to herein as a "small raised flat bevel" 10-1'.

In the case of a dagger blade (not shown), which has two opposing sharp edges, a small raised flat bevel will be formed at both of the sharp edges of the blade.

The edge of a Hollow Flat blade of the present invention may be sharpened either by grinding the small raised flat bevel 10-1', or by grinding the angled bevel 10-2. However, the preferred sharpening method would be to always sharpen the small raised flat bevel 10-1', and only knock off the burr on the angled bevel 10-2.

It will be understood by someone with ordinary skill in the art that the description herein of the Hollow Flat blade as having a convex side as well as a flat side is illustrative; other blade profiles in combination with the hollow ground flat side are possible. In addition, different blade designs may also be used; for example, tanto, drop point, etc. In all embodiments of a Hollow Flat blade, one side is a hollow ground flat side with a small raised flat bevel 10-1'; the edge profile of all Hollow Flat blades will be formed at the intersection of the small raised flat bevel 10-1' with an angled bevel 10-2; the angled bevel side of the Hollow Flat knife blade could be convex, flat, wedge, concave, or other profile variation.

It will be understood by someone with ordinary skill in the art that like other knife blade designs, the Hollow Flat blade, including Hollow Flat blade embodiments with spacing detent 32, could also have a serrated, non-serrated, or a combination of serrated and non-serrated edge.

For sharpening, the form of the Hollow Flat blade also makes it possible to sharpen only the small raised flat bevel 10-1' on the concave side 13-2'. The blade 1 and the sharpening device, e.g., along line 34-34 in FIG. 30*a*, must be at a zero degree angle relative to each other during the sharpening process. In addition, any kind of serrations in the knife blade are easily sharpened by sharpening the small raised flat bevel 10-1'.

In another exemplary embodiment of the present invention, the Hollow Flat blade is used in a folding knife containing an Integral Sharpener as was previously described above. In such a case, a spacing detent 32 is not necessary, since the zero degree angle is always maintained by using the folding element to form a sharpening contact between the blade 1 and a sharpening element (See e.g., FIGS. 15*a*, 15*b*, 16-26). Even though a spacing detent 32 would not have any influence on the sharpening process when using the Integral Sharpener, the blade could still have a spacing detent 32, which would then make it easy to use a separate, external sharpener and still ensure that the zero degree angle is maintained during the sharpening process. For example, sharpeners with different grades of grit may be used.

5. Making a Hollow Flat Blade

As will be understood by someone with ordinary skill in the art, it is possible to convert an existing knife blade, such as chisel ground blade, to a Hollow Flat blade. Someone with ordinary skills in the art will understand how to hollow ground the flat side of such a blade, creating a small raised flat bevel 10-1', a concave side 13-2', and an optional spacing detent 32, as depicted in FIG. 30*a*, using the appropriate equipment and tools.

With reference to FIG. 30*a*, the method of making a knife blade would be to hollow grind a flat side 13-2 of a knife blade 1. The knife blade 1 would have an edge 11 formed at an intersection between the angled bevel 10-2 disposed on one side, e.g., 13-1, of the knife blade 1 and the flat side, e.g., 13-2, of the knife blade 1. The hollow grinding would preserve a raised flat bevel 10-1' at the edge-forming intersection 11 between the angled bevel 10-2 and the flat side 13-2 of the knife blade 1. The hollow grinding would, in some embodiments, further preserve a spacing detent 32 disposed on the hollow ground flat side 13-2/13-2' of the blade 1 at an end 34 of the blade 1 opposing the blade edge 11, wherein the spacing detent has a height. In some embodiments, the height of the preserved spacing detent would be equal to the height of the preserved raised flat bevel. In some embodiments, such as depicted in FIG. 30*b*, a spacing detent 32' is a point of the flat side 13-2 remaining after the hollow grinding. In other embodiments, a Hollow Flat blade could be made by hollow grinding a channel on the flat side 13-2 of a knife blade 1, preserving a raised flat bevel 10-1' at the edge-forming intersection 11 between the angled bevel 10-2 and the flat side 13-2 of the knife blade 1 and also preserving a wide area of the flat side 13-2.

6. Sharpening Element Storage

Figure 41:
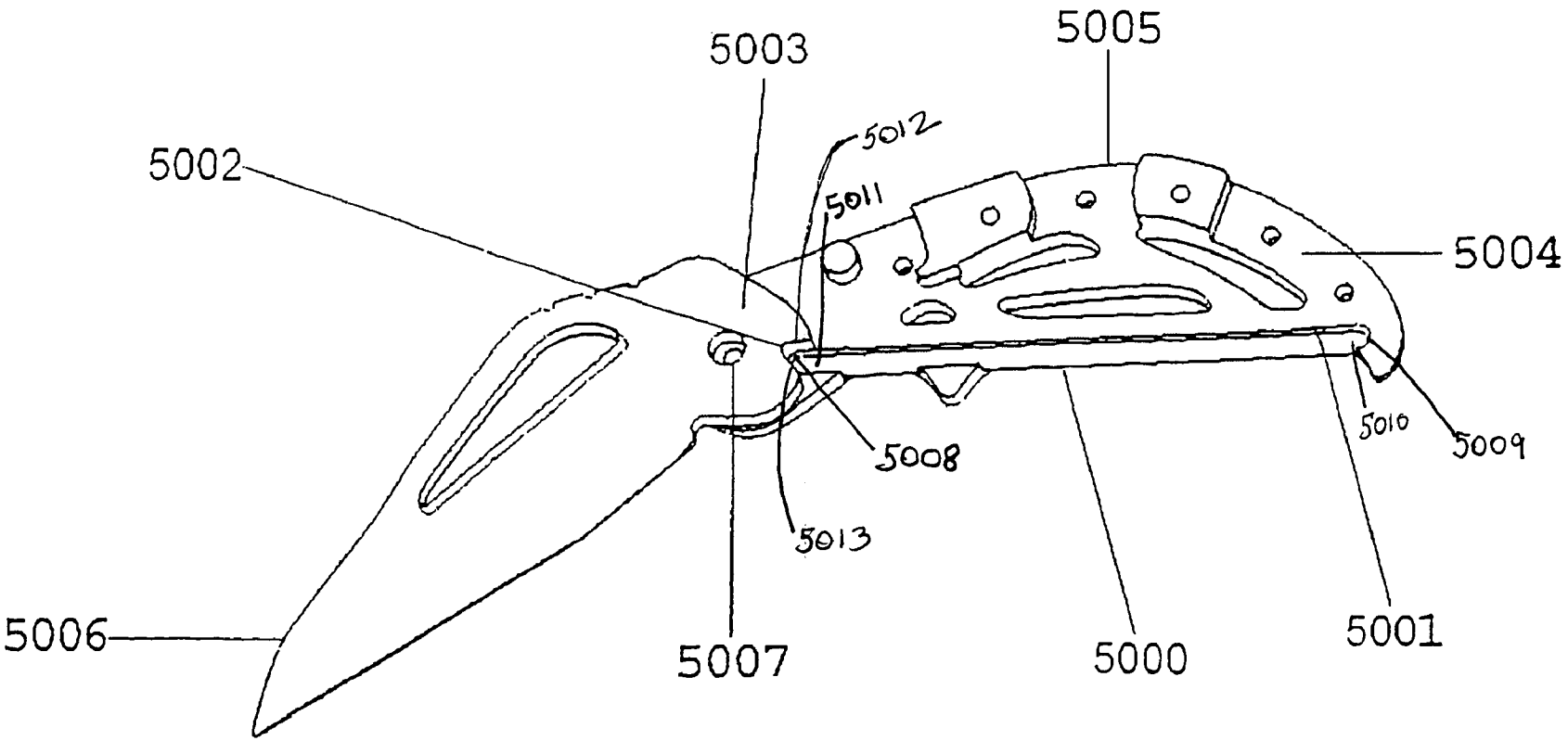
FIG. 41 provides a side elevation view of an exemplary folding knife blade, and a longitudinal (side) cross-sectional view of an exemplary handle with an exemplary groove for storing an exemplary exchangeable sharpening element in an exemplary sharpening element storage embodiment of the present invention.
Figure 42:
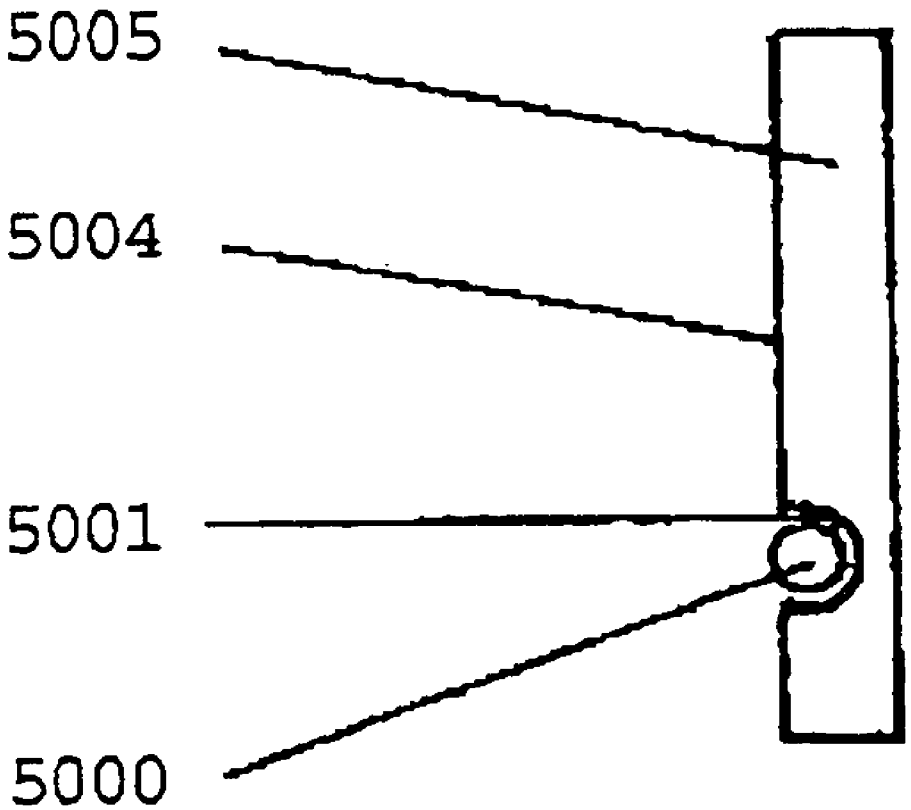
FIG. 42 provides a cross-sectional end view of an exemplary knife handle, with an exemplary groove for storing an exemplary exchangeable sharpening element in an exemplary sharpening element storage embodiment of the present invention.

In an exemplary sharpening element storage embodiment of the present invention, as depicted in FIGS. 41 and 42, a sharpening element 5000 may be inserted in a groove 5001 that would be provided in an interior wall 5004 of a knife handle (or knife blade housing) 5005.

In the exemplary sharpening element storage embodiment of the present invention, as depicted in FIG. 41, a first end 5008 of the groove 5001, near a pivot 5007 of knife blade 5006, would be provided. In the exemplary sharpening element storage embodiment of the present invention, a knife blade 5006 would provide a first notch 5002. In the exemplary sharpening element storage embodiment of the present invention, the first notch 5002 in the knife blade 5006 would be slightly V-shaped and would not conform with the shape of the first end 5008 of the groove 5001.

In the exemplary sharpening element storage embodiment of the present invention, as depicted in FIG. 41, a second end 5009 of the groove 5001, would be provided at an opposite end of the knife handle as compared to the location of the first end 5008 of the groove 5001. In the exemplary sharpening element storage embodiment of the present invention, the second end 5009 of the groove 5001 would form a rounded pocket for receiving a first end 5010 of the sharpening element 5000. Second end 5009 would slightly enclose first end 5010 of the sharpening element 5000 when the first end 5010 is seated in second end 5009.

When the first notch 5002, located in the blade's tongue 5003, in the knife blade 5006 is aligned with the V-shaped first end 5008 of the groove 5001 as depicted in FIG. 41, it would be possible to move a second end 5011 of sharpening element 5000 in the direction of the opposing handle part (not shown), out from the groove 5001. In the exemplary sharpening element storage embodiment of the present invention, in order to extract the sharpening element 5000 completely out from the knife handle 5005 for use, the user would continue to move the blade 5006 in the opening direction to lodge a first edge 5012 of the notch 5002 under the second end 5011 of the sharpening element 5000. Once the first edge 5012 of the notch 5002 is lodged under the second end 5011 of the sharpening element 5000, the user would continue to move the blade 5006 in the opening direction in order to urge the sharpening element 5000 completely out of groove 5001.

Unless the first notch 5002 in the knife blade 5006 is aligned with the first end 5008 of the groove 5001, as depicted in FIG. 41, the blade 5006 and the pocket formed at the first end 5009 of the groove 5001 would hold sharpening element 5000 in place in groove 5001, such as to prevent the sharpening element 5000 from accidentally moving or falling out of the groove 5001. The sharpening element 5000 may be removed only when the first notch 5002, located in the blade's tongue 5003, is rotated to a specific angle to align with the second end 5008 of the groove 5001 to create an opening. Alignment would be done by moving the blade 5006 up or down (opening or closing) out of or into the handle 5005. Only when the first notch 5002 is rotated to a specific angle to align with the second end 5008 of the groove 5001, would it be possible to extract the sharpening element 5000 from its storage in groove 5001.

Similarly, in order to place the sharpening element 5000 back into the groove 5001 for storage, the knife blade 5006 would be moved up out of the handle (open) or down into the handle (close) to align the first notch 5002 in the blade's tongue 5003 to a specific angle to align with the second end 5008 of the groove 5001 to create an opening so that the sharpening element 5000 could be placed back in groove 5001. In order to lodge the sharpening element 5000 back into groove 5001, the user would first place the first end 5010 of the sharpening element 5000 into the pocket of the second end 5009 of the groove 5001. The user would then place the second end 5011 of the sharpening element on a second edge 5013 of the V-shaped notch 5002. The user would then move the blade in a closing direction to urge the sharpening element into groove 5001.

As will be understood by someone with ordinary skill in the art, the first notch 5002 could be made to be various shapes or a larger size than the first end 5008 of the groove 5001 without departing form the spirit of the present invention. However, an increase in the size or change in the shape of the first notch 5002 as compared with the size and/or shape of the first end 5008 of the groove 5001, could allow an expanded range of movement of the knife blade during which the sharpening element 5000 could be dislodged from groove 5001.

As will be understood by someone with ordinary skill in the art, other features of the invention are depicted or are implicit in the accompanying Figures and above-provided description.

Facsimile Reproduction of Copyright Material

A portion of the disclosure of this patent document, including but not limited to the renderings of various aspects of the invention in the drawings, contains material which is subject to copyright protection by the copyright owner, the inventors or the successors or assigns of the inventors. The copyright owner has no objection to the facsimile reproduction by anyone of the patent document or the patent disclosure, as it appears in the Patent and Trademark Office patent file or records, but otherwise reserves all copyright rights whatsoever.

Trademarks

The names of actual companies and products mentioned herein may be the trademarks of their respective owners.

Illustrative Embodiments

Although this invention has been described in certain specific embodiments, many additional modifications and variations would be apparent to those skilled in the art. It is, therefore, to be understood that this invention may be practiced otherwise than as specifically described. Following, is a non-limiting list of exemplary combinations of various features of the present invention. It will be understood by someone with ordinary skill in the art that some of the possible combinations of elements may be more or less preferable than others for various reasons.

A Hollow Flat blade may be implemented in the following, non-limiting exemplary ways: serrated, non-serrated, or as a combination serrated and non-serrated.

Whether or not serrated, non-serrated, or as a combination of serrated and non-serrated, a Hollow Flat blade may be implemented in the following, non-limiting exemplary ways: without an integral sharpener, with or without a spacing detent; or with an integral sharpener, with or without a spacing detent.

A chisel ground blade can be converted to a Hollow Flat blade, with or without a spacing detent.

A selective sharpening embodiment of the present invention can be implemented with serrated knife blades, non-serrated knife blades and/or combination serrated and non-serrated knife blades.

Whether or not a selective sharpening embodiment of the present invention is implemented with a serrated knife blade, a non-serrated knife blade or a combination serrated and non-serrated knife blade, the blade may be a conventional blade, a chisel ground blade, or a Hollow Flat blade.

Whether or not a selective sharpening embodiment of the present invention is implemented with a serrated knife blade, a non-serrated knife blade or a combination serrated and non-serrated knife blade, and whether or not the blade is a conventional blade, a chisel ground glace, or a Hollow Flat blade, the selective sharpening element may be implemented as a fixed element, as a push button activated (or other activated) element, as a combination fixed and push button activated (or other activated) element, or as an exchangeable element.

A non-selective sharpening embodiment of the present invention can be implemented with serrated knife blades, non-serrated knife blades and/or combination serrated and non-serrated knife blades.

Whether or not a non-selective sharpening embodiment of the present invention is implemented with a serrated knife blade, a non-serrated knife blade or a combination serrated and non-serrated knife blade, a non-selective sharpening embodiment of the present invention may be implemented to be moveably mounted with springs.

Whether or not a non-selective sharpening embodiment of the present invention is implemented with a serrated knife blade, a non-serrated knife blade or a combination serrated and non-serrated knife blade, and whether or not a non-selective sharpening embodiment of the present invention is implemented to be moveably mounted with springs, a non-selective sharpening embodiment of the present invention may be implemented with a conventional blade, a chisel ground blade, or a Hollow Flat blade.

The present invention can be implemented in combination selective and non-selective embodiments for serrated, non-serrated, and/or combination serrated and non-serrated blades. In a combination selective and non-selective embodiment, one of the sharpening elements would be fixed; the other, spring-mounted. A combination selective and non-selective embodiment could be used with a Hollow Flat blade.

Thus, the embodiments of the invention described herein should be considered in all respects as illustrative and not restrictive, the scope of the invention to be determined by the appended claims and their equivalents rather than the foregoing description.

What is claimed is:

1. A folding knife, said folding knife comprising:

(A) a blade, said blade comprising:

(1) a first blade side, said first blade side comprising first and second angled bevels, said each angled bevel comprising an angled bevel surface, said each angled bevel surface comprising an angle relative to a centerline of said blade, wherein said each angle is greater than zero degrees, and a remaining surface of said first blade side may have a convex surface, wherein said second angled bevel surface is disposed between said first angled bevel surface and said convex surface;

(2) a second blade side, said second blade side comprising a concave indentation laterally disposed along said second blade side, said second blade side further comprising a raised flat bevel, said raised flat bevel comprising a flat surface, wherein said flat surface substantially comprises a first portion of the centerline of the blade and said flat surface meets said first angled bevel surface to form a sharp cutting edge;

(3) a sharp edge, wherein the sharp edge is formed at an intersection of the angled bevel surface of the angled bevel and the flat surface of the raised flat bevel, (4) a second edge, wherein said second edge opposes the sharp edge, wherein the centerline of the blade extends from the sharp edge of the blade to second edge of the blade, and (5) a spacing detent disposed on the second blade side along the second edge of the blade, wherein the spacing detent comprises a spacing detent surface and wherein the spacing detent surface substantially comprises a second portion of the centerline of the blade, wherein said spacing detent surface serves as a guide for sharpening the raised flat bevel;

(B) a blade housing comprising an interior and an exterior, said interior comprising a first interior side and a second interior side, wherein said first interior side faces the first blade side, wherein the second interior side faces the second blade side, wherein the second interior side is substantially parallel to the flat surface of the flat bevel, wherein the second interior side comprises a recess laterally disposed along the second interior side, and wherein the recess is adapted for receiving a sharpening element;

(C) a folding element connecting the blade to the interior of the blade housing, wherein said folding element is operable for opening the blade out of the blade housing, and is operable for closing the blade into the blade housing, and wherein the folding element connects the blade to the interior of the blade housing allowing lateral wiggle of the blade; and (D) a sharpening element comprising a first grinding surface, wherein the sharpening element is adapted for lodging within the recess in the second interior side exposing the first grinding surface for sharpening contact with the flat surface of the flat bevel, wherein the first grinding surface of the sharpening element when lodged in the recess is parallel to the centerline of the blade, and is parallel to the flat surface of the raised flat bevel when the blade is closed into the blade housing, wherein the first grinding surface of the sharpening element is adapted for grinding the flat surface of the raised flat bevel under a condition selected from a group consisting of:

(1) as a pressure is applied to the first blade side as the blade is closed into the blade housing, and (2) as a pressure is applied to the first blade side as the blade is opened out of the blade housing.

2. The folding knife of claim 1, wherein the blade is adapted for selective grinding of the flat surface of the raised flat bevel against the first grinding surface of the sharpening element under a selective grinding condition selected from the selective grinding condition group consisting of:

(1) as a closing pressure is applied to the blade to direct the flat surface of the raised flat bevel against the first grinding surface of the sharpening element as the blade is closed into the blade housing, and (2) as an opening pressure is applied to the blade to direct the flat surface of the raised flat bevel against the first grinding surface of the sharpening element as the blade is opened out of the blade housing.

3. The folding knife of claim 1, wherein the sharpening element comprises a multi-surfaced sharpening element, wherein the multi-surfaced sharpening element comprises a first sharpening surface comprising a first sharpening grit and wherein the multi-surfaced sharpening element further comprises at least a second surface, wherein said second surface comprises at least one of: a second sharpening grit, or a plain surface.

4. The folding knife of claim 1, wherein the sharpening element is rod-shaped, and wherein a circumference of an end view of said rod-shaped sharpening element comprises a substantially round circumference.

5. The folding knife of claim 1, wherein the sharpening element comprises multiple sharpening surfaces, wherein the multi-surfaced sharpening element is rod-shaped, and wherein a circumference of an end view of said rod-shaped sharpening element comprises a substantially square circumference.

6. The folding knife of claim 1, wherein the sharpening element comprises, multiple sharpening surfaces, wherein the multi-surfaced sharpening element is rod-shaped, and wherein a circumference of an end view of said rod-shaped sharpening element comprises a substantially triangular circumference.

7. The folding knife of claim 1, wherein the sharpening element comprises multiple sharpening surfaces, wherein the multi-surfaced sharpening element is rod-shaped, and wherein a circumference of an end view of said rod-shaped sharpening element comprises a substantially pentagonal circumference.

8. The folding knife of claim 1, wherein the sharpening element comprises multiple sharpening surfaces, wherein the multi-surfaced sharpening element is rod-shaped, and wherein a circumference of an end view of said rod-shaped sharpening element comprises a substantially hexagonal circumference.

* * * * *